US008627609B2

(12) United States Patent
Beausolell

(10) Patent No.: US 8,627,609 B2
(45) Date of Patent: Jan. 14, 2014

(54) MOUNTING DEVICES FOR SECURING LIGHT FIXTURES TO LANDSCAPE WALLS

(76) Inventor: David M. Beausolell, Ridgewood, NJ (US)

( * ) Notice: Subject to any disclaimer, the term of this patent is extended or adjusted under 35 U.S.C. 154(b) by 111 days.

(21) Appl. No.: 13/187,719

(22) Filed: Jul. 21, 2011

(65) Prior Publication Data

US 2013/0020450 A1 Jan. 24, 2013

(51) Int. Cl.
*E04F 19/00* (2006.01)

(52) U.S. Cl.
USPC ..... 52/28; 52/220.1; 52/220.2; 52/302.4; 52/606; 52/607

(58) Field of Classification Search
USPC ..... 52/28, 220.1, 220.2, 220.3, 220.5, 52/220.7, 302.3, 302.4, 606, 607
See application file for complete search history.

(56) References Cited

U.S. PATENT DOCUMENTS

| | | | | | |
|---|---|---|---|---|---|
| 891,313 | A | * | 6/1908 | White | 52/583.1 |
| 3,055,510 | A | | 2/1960 | Coates | |
| D281,725 | S | | 12/1985 | Schreiner | |
| D283,550 | S | | 4/1986 | Greco | |
| 4,797,112 | A | | 1/1989 | Weisenburger | |
| D303,849 | S | | 10/1989 | Nugent | |
| D318,536 | S | | 7/1991 | Jones et al. | |
| 5,044,971 | A | | 9/1991 | Hollingsworth | |
| D322,813 | S | | 12/1991 | Wilson | |
| 5,072,566 | A | | 12/1991 | Zeidman | |
| D333,086 | S | | 2/1993 | Karas et al. | |
| D337,011 | S | | 7/1993 | Duffy et al. | |
| 5,258,572 | A | * | 11/1993 | Ozeki et al. | 174/38 |
| D351,195 | S | | 10/1994 | Altman | |
| D361,138 | S | | 8/1995 | Moore et al. | |
| D382,245 | S | | 8/1997 | Bedrosian et al. | |
| D397,489 | S | | 8/1998 | Alexander | |
| 5,943,827 | A | | 8/1999 | Okerlund | |
| D422,107 | S | | 3/2000 | Meier | |
| D429,457 | S | | 8/2000 | Thomas | |
| 6,122,881 | A | | 9/2000 | Aubertot | |
| D454,962 | S | | 3/2002 | Grace | |
| 6,360,508 | B1 | | 3/2002 | Pelfrey et al. | |
| D482,261 | S | | 11/2003 | Kobayashi | |
| 6,708,504 | B2 | | 3/2004 | Brandt et al. | |
| 6,976,765 | B2 | | 12/2005 | Helenowski | |

(Continued)

OTHER PUBLICATIONS

Integral Lighting brochure entitled, "Hardscape Lighting Solutions," Integral Lighting, 165 West Fairview Street, Wernersville, PA 19565, www.integral-lighting.com, 16 pp., 2010.

*Primary Examiner* — Charles A Fox
*Assistant Examiner* — Patrick Maestri
(74) *Attorney, Agent, or Firm* — Doherty & Charney LLC

(57) ABSTRACT

A mounting system for securing a light fixture to a wall includes a mounting device having a flat plate with a leading edge, a trailing edge, and top and bottom planar surfaces extending between the leading and trailing edges. An elongated slot is formed in the flat plate and extends along the leading edge of the flat plate. The mounting device has a storage compartment underlying the flat plate for defining an enclosed area extending between the leading and trailing edges of the flat plate. The mounting system includes a conduit adapter coupled with the storage compartment. The conduit adapter has at least opening aligned with the rear opening of the storage compartment for providing access to the enclosed area of the storage compartment. A conduit, adapted to receive electrical wiring, is coupled with the at least one opening. Electrical wiring is passed through the conduit.

22 Claims, 24 Drawing Sheets

(56) References Cited

U.S. PATENT DOCUMENTS

| | | | | |
|---|---|---|---|---|
| D534,790 | S | 1/2007 | Garda | |
| D550,541 | S | 9/2007 | Blanchard | |
| 7,290,904 | B2 * | 11/2007 | Miller | 362/432 |
| D564,128 | S | 3/2008 | Hartman | |
| D570,037 | S | 5/2008 | Hartman | |
| D576,763 | S | 9/2008 | Hartman | |
| D583,649 | S | 12/2008 | Parker | |
| D586,453 | S | 2/2009 | Yusa et al. | |
| 7,524,077 | B2 * | 4/2009 | Hartman | 362/145 |
| D621,989 | S | 8/2010 | Proner | |
| D639,142 | S | 6/2011 | Antonic | |
| D649,695 | S | 11/2011 | Beausoleil | |
| 2005/0115176 | A1 * | 6/2005 | Russell | 52/220.1 |
| 2008/0128162 | A1 * | 6/2008 | Muehlebach | 174/481 |
| 2009/0071682 | A1 * | 3/2009 | Crawford, Jr. | 174/66 |
| 2009/0288354 | A1 | 11/2009 | Donohew | |

* cited by examiner

MOUNTING DEVICES FOR SECURING LIGHT FIXTURES TO LANDSCAPE WALLS

BACKGROUND OF THE INVENTION

1. Field of the Invention

The present invention is generally related to light fixtures and is more specifically related to mounting systems and devices used for securing light fixtures to walls, such as pre-engineered, natural stone, wet laid mortar, brick, decorative block, structural landscape walls, and retaining walls.

2. Description of the Related Art

Light fixtures are often attached to landscape walls to provide pathway lighting, task lighting, and aesthetically pleasing light patterns. Difficulties arise, however, when it later becomes necessary to remove a light fixture from a landscape wall to perform maintenance or repairs. In some instances, the landscape wall must be at least partially disassembled to remove the light fixture and/or access electrical wiring used to power the light fixture. Frequently, the electrical wiring needs to be replaced, but is embedded in a cured mortar layer or adhesive. Thus, repairing and maintaining light fixtures on landscape walls can be an expensive and time consuming process that requires the services of both a mason and an electrician.

There have been many efforts directed to providing mounting devices and systems for securing light fixtures to landscape walls. For Example, U.S. Pat. No. 7,290,904 to Miller discloses a lighting system having an elongated light fixture support flange that is positioned between the blocks of a wall. The elongated flange includes a stop member that provides an indication of when the elongated flange has been sufficiently advanced between two blocks of the wall. The elongated flange has a coupling member, and the light fixture has a bracket used for securing the light fixture to the coupling member. The bracket provides for easy removal and positioning of the light fixture relative to the elongated flange. When it is desired to perform maintenance on the light fixture, the light fixture is removed from the coupling member by sliding the bracket off of the coupling member.

U.S. Pat. No. 7,524,077 to Hartman discloses a lamp used for illuminating a wall constructed of blocks. The lamp includes a plate having a flange attached thereto, with a light fixture attached to the inner face of the flange. The lamp is integrated into a retaining wall by sliding the plate between the blocks, whereby the electrical wiring extending from the rear of the lamp runs between the block-like elements. U.S. Design Pat. Nos. D564,128 and D570,037 are related to the '077 Hartman patent, and disclose ornamental designs for a light fixture and an asymmetric light fixture, respectively.

Integral Lighting of Wernersville, Pa. sells a flat mounting plate that is positioned beneath a cap stone of a wet mortar wall. A light fixture is positioned atop the flat mounting plate. The electrical wiring for the light fixture extends between the underside of a capstone and the upper surface of the flat mounting plate. The electrical wiring is exposed to the environment and is locked in place by the mortar layer.

U.S. Pat. No. 6,976,765 to Helenowski discloses a light source that is disposed within a block-shaped enclosure that forms a part of a wall. The enclosure is the same size and shape as one of the blocks of the wall, and may be utilized in place of one of the blocks when the wall is built. The enclosure may also be substituted for one of the blocks after the wall is built. In one embodiment, a support bar is disposed within the wall and welded to the enclosure for preventing the enclosure from being removed from the wall.

U.S. Pat. No. 5,943,827 to Okerlund discloses a retaining wall block having recesses and channels formed therein for receiving light fixtures and electrical wiring. In one embodiment, an underside of a block has a recess for a light fixture and a channel for electrical wiring. The light fixture is inserted into the recess and the electrical wiring for the light fixture is inserted into the channel.

In spite of the above advances, there remains a need for improved mounting systems and devices for securing light fixtures to walls made of blocks, bricks, natural stone or pre-engineered wall systems. There also remains a need for light fixture mounting systems and devices that facilitate the installation, repair and maintenance of the light fixtures and the electrical wiring used to power the light fixtures. In addition, there remains a need for a mounting devices and systems having storage compartments that are adapted for receiving, storing, and protecting from the environment, the electrical wiring used to power the light fixtures.

SUMMARY OF THE INVENTION

In one embodiment, a system for securing light fixtures to a wall includes at least one mounting device adapted to be affixed to a wall, such as a wet mortar wall or an engineered block wall, during initial construction. In one embodiment, the mounting device preferably has an L-shaped configuration and includes a flat, horizontally-extending plate having an elongated slot adapted to receive a securing flange projecting from a rear end of a light fixture, and a storage compartment positioned beneath the elongated slot that is adapted to receive and store electrical wires and the accompanying raceway/conduit that connect the light fixture to a power source.

In one embodiment, a series of mounting devices may be placed along the length of a wall for mounting a plurality of light fixtures to the wall. During initial wall construction, a mason may pre-position multiple mounting devices within a wet mortar layer at various locations along the length of the wall. The mounting device enables an installer to run flexible conduit to the back of each device so that electrical wires may be passed through the conduit for initial installation, or removed and replaced in the event of failure. The mounting device, and particularly the storage compartment of the mounting device, protects the electrical wires from exposure to the environment.

After the wall has been built, a lighting contractor may connect the electrical wiring with each of the light fixtures. In one embodiment, a light fixture is mounted to a wall by slipping the securing flange on the light fixture into the elongated slot of the mounting device. The friction between the securing flange and inner faces of the elongated slot holds the light fixture in place. The storage compartment of the mounting device provides a protected area for placing the electrical wiring that extends from the rear of the light fixture. Any slack electrical wiring may be folded and stored in the storage compartment. The mounting device enables an installer to easily remove, repair, replace, maintain, clean, and then reinstall the light fixture in a wall.

In one embodiment, a mounting system for securing a light fixture to a wall, such as a landscape wall, engineered block wall, wet laid mortar wall, natural stone wall or retaining wall, preferably includes a mounting device having a flat plate with a top planar surface, a bottom planar surface, and an elongated slot extending between the top and bottom planar surfaces and along an edge of the flat plate. The elongated slot formed in the flat plate preferably has a length of about 4-8 inches and more preferably about 6 inches, and a width of about 0.030-0.050 inches and more preferably about 0.040 inches. The mounting device also desirably includes a storage compartment defining an enclosed area underlying the bottom planar surface of the flat plate. The enclosed area of the storage compartment is adapted for receiving electrical wiring used for interconnecting a light fixture with a power source.

The mounting system desirably includes a light fixture having a securing flange projecting therefrom that is insertable into the elongated slot of the mounting device for securing the light fixture to the mounting device. The securing flange projecting from the light fixture preferably has a thickness that closely matches the width of the elongated slot for forming a friction fit when the securing flange is inserted into the elongated slot. When sliding the securing flange into the elongated slot for securing the light fixture to the mounting device, the securing flange frictionally engages the opposing faces of the elongated slot for securing the light fixture to the mounting device. The frictional engagement holds the light fixture in place, while enabling the light fixture to be quickly removed from the elongated slot, if necessary, for replacing, maintaining and/or repairing the light fixture. After replacement, maintenance and/or repairs are completed, the light fixture may be quickly and easily re-secured to the mounting device by sliding the securing flange back into the elongated slot.

In one embodiment, the flat plate of the mounting device preferably has a leading edge and a trailing edge, whereby the top and bottom planar surfaces extend between the leading and trailing edges. The elongated slot desirably extends along the leading edge of the flat plate, and the storage compartment preferably extends between the leading and trailing edges of the flat plate.

In one embodiment, the flat plate has first and second lateral edges extending between the leading and trailing edges, and the storage compartment is located adjacent one of the first and second lateral edges of the flat plate. The storage compartment preferably has a front opening extending along the leading edge of the flat plate and a rear opening extending along the trailing edge of the flat plate. The front and rear openings provide access to the enclosed area of the storage compartment so that conduits and electrical wiring may be directed to the enclosed area.

In one embodiment, the storage compartment includes a bottom wall that opposes the bottom planar surface and a pair of opposing side walls that extend from the bottom wall to the bottom planar surface for defining the enclosed area of the storage compartment. The bottom wall of the storage compartment is preferably parallel with the top and bottom planar surfaces of the flat plate and the pair of opposing sidewalls of the storage compartment are desirably perpendicular to the top and bottom planar surfaces of the flat plate. As such, the storage compartment preferably has a square or rectangular configuration.

In one embodiment, the mounting system desirably includes a conduit adapter coupled with the storage compartment. The conduit adapter preferably has at least one opening aligned with the rear opening of the storage compartment. In one embodiment, the conduit adapter includes a support plate having an inner face and an outer face, and a plug projecting from the inner face of the support plate. In one embodiment, the plug preferably has an outer perimeter that closely matches an inner perimeter of the rear opening of the storage compartment for forming a frictional engagement between the plug and the rear opening. In one embodiment, the conduit adapter is bonded to the rear opening of the storage compartment using an adhesive, glue or solvent such as PVC cement that bonds the conduit adapter to the storage compartment.

In one embodiment, the at least one opening formed in the conduit adapter preferably passes through the support plate and the plug. The system desirably includes a conduit, such as a flexible conduit, coupled with the at least one opening in the conduit adapter. The conduit desirably has a central opening adapted to receive electrical wiring that is connected with the light fixture. In one embodiment, the at least one opening in the conduit adapter preferably includes two or more openings extending through the support plate and the plug. Each of the openings is capable of receiving a conduit, and each conduit, in turn, is capable of receiving electrical wiring that extends into said storage compartment. The conduit adapter may have tubes that define the openings, whereby the conduits are insertable into the tubes for directing electrical wiring toward the mounting devices.

In one embodiment, a mounting system for securing a light fixture to a landscape wall preferably includes a mounting device having a flat plate with a leading edge, a trailing edge, and top and bottom planar surfaces extending between the leading and trailing edges, and an elongated slot formed in the flat plate, the elongated slot extending between the top and bottom planar surfaces and along the leading edge of the flat plate. The mounting device desirably includes a storage compartment underlying the flat plate, the storage compartment defining an enclosed area extending between the leading and trailing edges of the flat plate. The storage compartment preferably has a front opening extending along the leading edge of the flat plate and a rear opening extending along the trailing edge of the flat plate.

In one embodiment, a conduit adapter is preferably inserted into the rear opening of the storage compartment. The conduit adapted desirably has at least opening aligned with the rear opening of the storage compartment for providing access to the enclosed area of the storage compartment. A conduit is desirably coupled with the at least one opening. The conduit preferably has a central opening through which electrical wiring may be advanced for being interconnected with a light fixture secured to the mounting device.

In one embodiment, the mounting devices and the conduit (s) may be pre-positioned during initial construction of a wall. Later, after the wall construction has been completed, electrical wiring may be passed through the conduit(s) for providing power to the light fixtures at each mounting device. After the electrical interconnections have been made, any excess wiring may be packed into the storage compartments and the securing flanges of the light fixtures may be inserted into the elongated slots on the mounting devices. In one embodiment, the excess wiring in the storage compartment may be held in place by using the flat back side of the lighting fixture, which effectively closes the front opening of the storage compartment when the light fixture is fully inserted in the mounting device.

In one embodiment, a wall, such as a landscape wall or a retaining wall, desirably includes a top row of blocks and at least one mounting device overlies the top row of blocks. In one embodiment, a plurality of mounting devices overlies the top row of blocks and are spaced along the length of the wall.

The system may include a mortar layer having a top surface overlying the top row of blocks, whereby each mounting device is embedded in the mortar layer so that the top planar surface of the flat plate is coplanar with the top surface of the mortar layer and so that the storage compartment of the mounting device is positioned below the top surface of the mortar layer. In one embodiment, a wet mortar layer is formed atop the wall, and one or more mounting devices are embedded in the wet mortar layer so that the top planar surfaces of the flat plates of the mounting device lie in a plane defined by the top surface of the wet mortar layer. The wet mortar layer may then be allowed to cure for locking the mounting devices in place within the wet mortar layer, whereby the elongated slots and the front storage compartment openings of the mounting devices are accessible at the front face of the wall. In one embodiment, the mounting devices disclosed herein may be placed at any level or row of a wall, and are not limited to placement under a cap stone or a top or uppermost layer of a wall.

In one embodiment, an adhesive label may be used for sealing the storage compartment and the elongated slot in the flat plate from construction debris. The label may bear the manufacturer's name or logo, and/or instructions for utilizing the light fixture mounting system. The adhesive label may be placed over the bottom wall for sealing the elongated gap in the bottom wall of the storage compartment so as to prevent concrete and other construction debris from entering the enclosed area of the storage compartment. The front flap of the adhesive label may be wrapped around the front of the mounting device for covering the front opening of the storage compartment. The free end of the front flap may be adhered to the top planar surface of the flat plate for protecting the storage compartment and at least a portion of the elongated slot formed in the flat plate. The front flap of the adhesive label may be opened and closed as necessary by peeling the front flap away from the flat plate and later re-adhering the front flap of the adhesive label to the top planar surface of the flat plate.

In one embodiment, the adhesive label may be used for holding electrical wires in place prior to the wires being electrically interconnected with a light fixture. Electrical wires may be passed through flexible conduit and the front opening of the storage compartment for being pre-positioned to extend from the front of the mounting device. The adhesive label preferably holds the electrical wires in place and seals the front of the storage compartment to prevent construction debris from entering the storage compartment and at least a portion of the elongated slot formed in the flat plate. When it is desired to secure a light fixture to the mounting device, the front flap of the adhesive label may be peeled away for exposing the front opening of the storage compartment so that the electrical wires may be electrically interconnected with a light fixture.

These and other preferred embodiments of the present invention will be described in more detail below.

DETAILED DESCRIPTION

Figure 1:
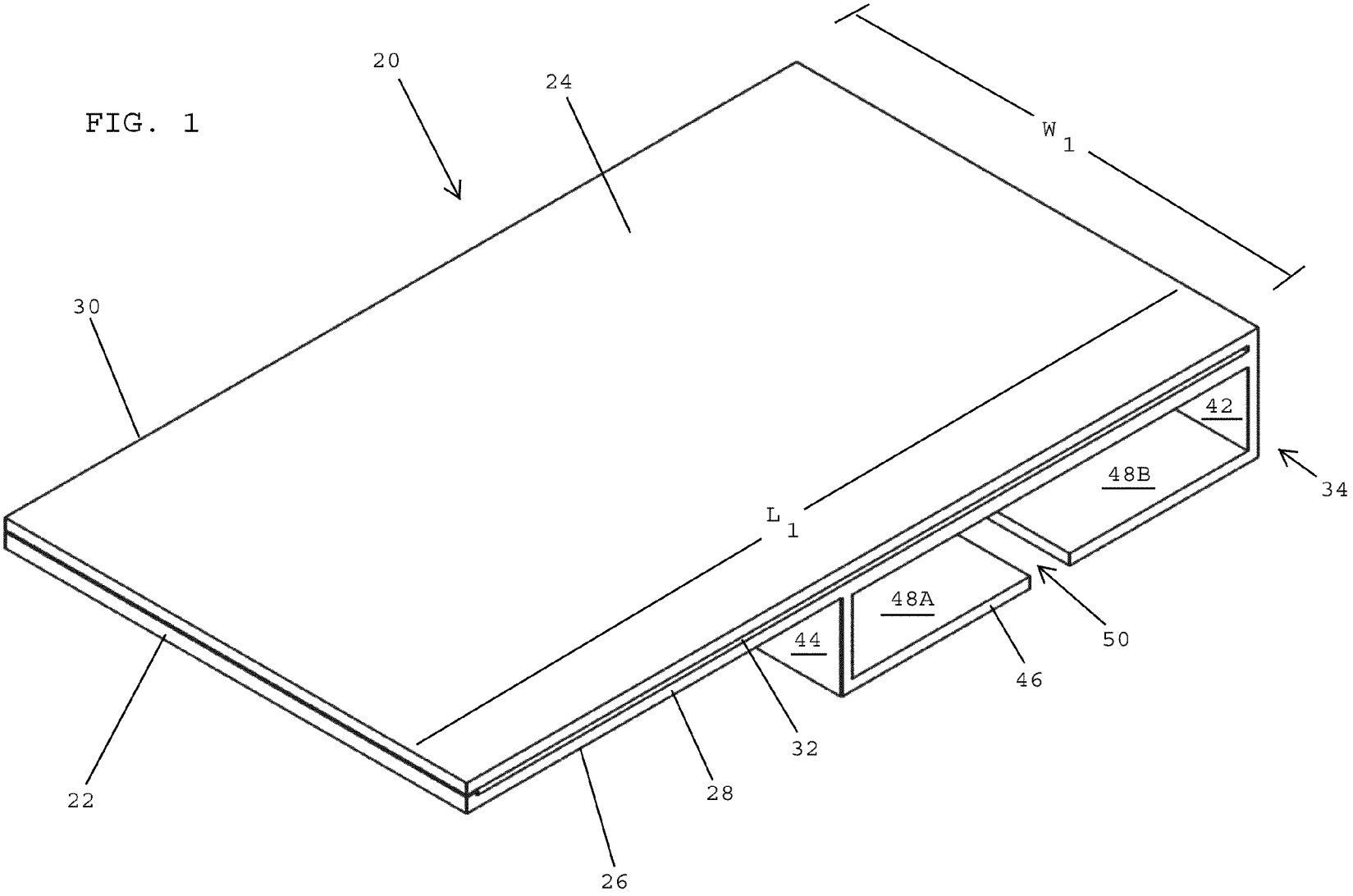
FIG. 1 is a perspective view of a mounting device for securing a light fixture to a landscape wall, in accordance with one embodiment of the present invention.
Figure 2:
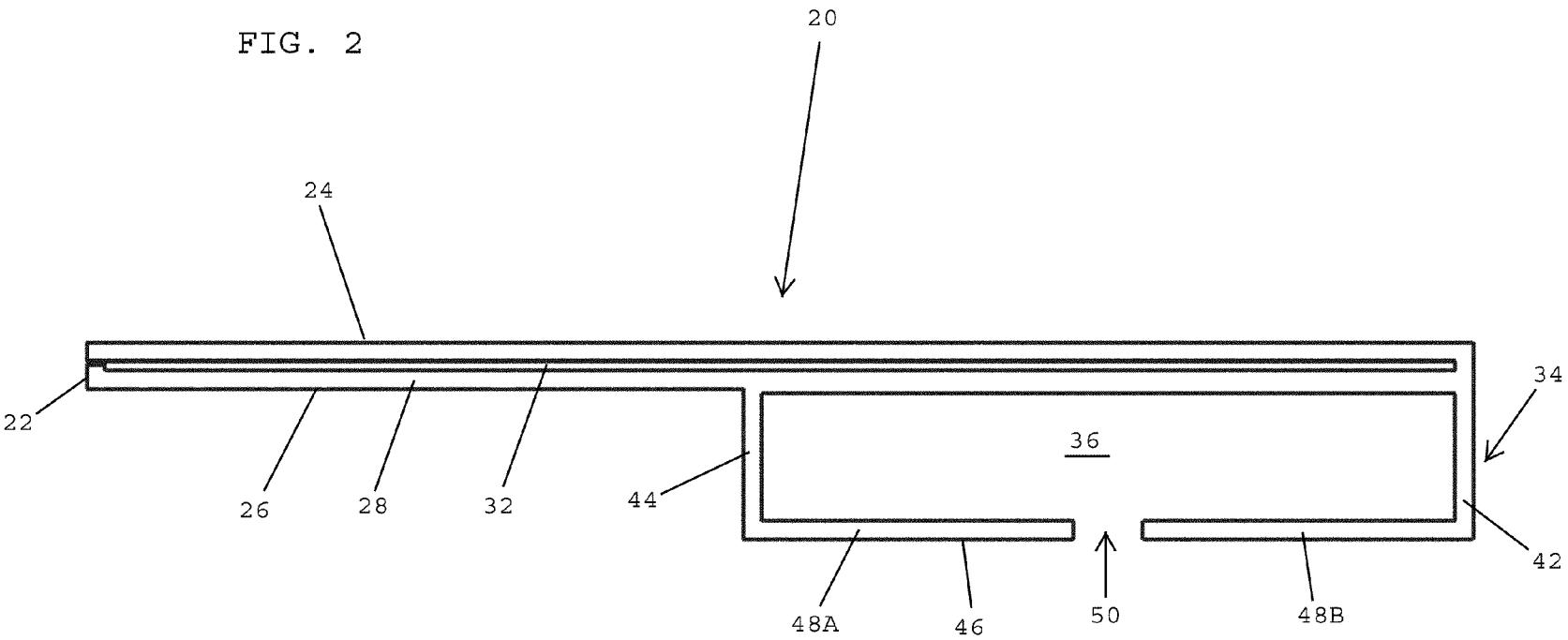
FIG. 2 is a front elevational view of the mounting device shown in FIG. 1.
Figure 3:
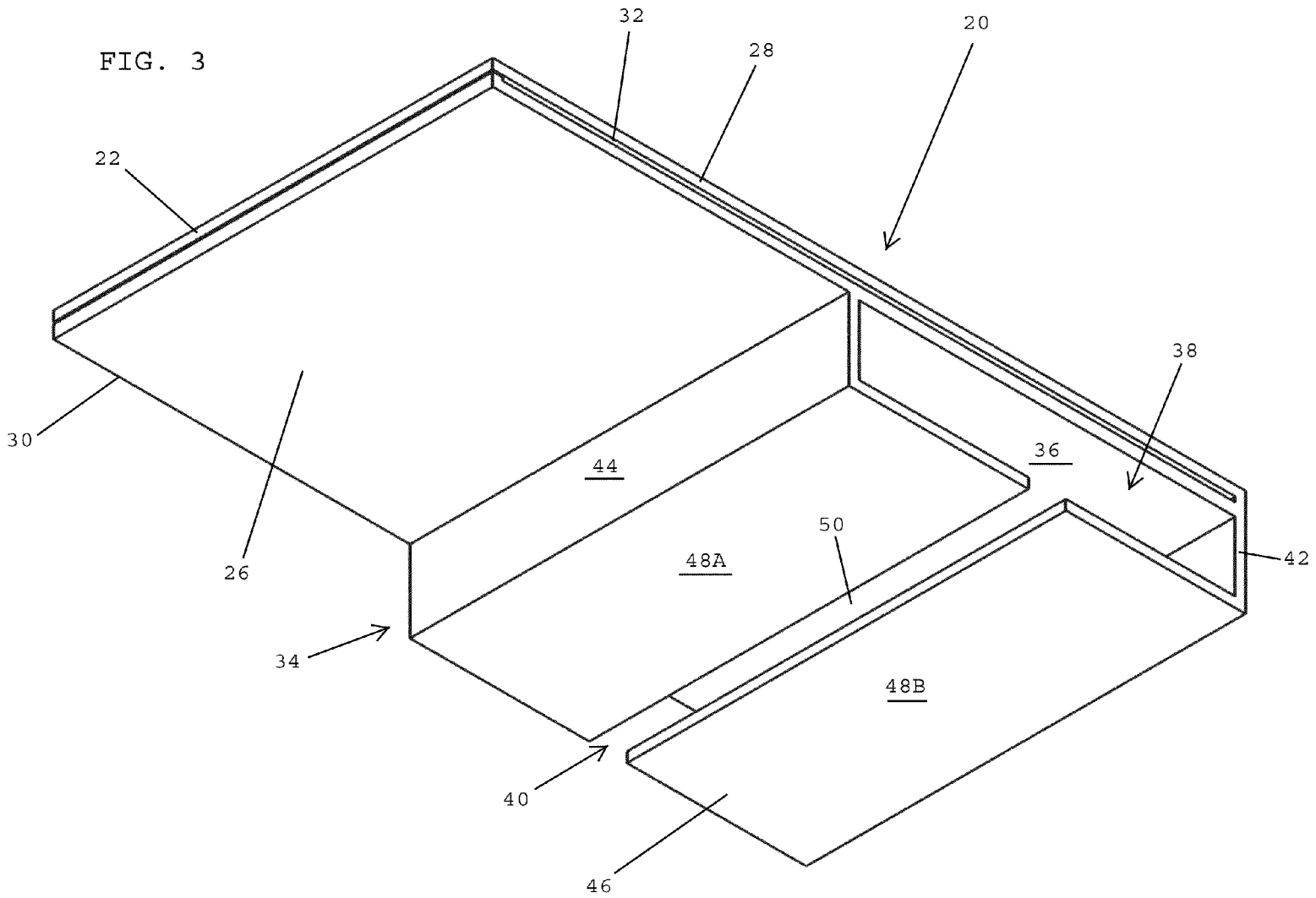
FIG. 3 is a bottom perspective view of the mounting device shown in FIGS. 1 and 2.

Referring to FIGS. 1-3, in one embodiment, a mounting device 20 for securing a light fixture to a wall, such as a landscape wall or a retaining wall, preferably includes a flat plate 22 having a top planar surface 24 and a bottom planar surface 26. The flat plate desirably includes a leading edge 28 that extends along the front face of the mounting device 20 and a trailing edge 30 that extends along a rear face of the mounting device. In one embodiment, the flat plate 22 has a length $L_1$ of about 5-7 inches and more preferably about 8 inches, and a width $W_1$ of about 3-4 inches, and more preferably about 3.5 inches. The walls of the mounting device are preferably about 0.05-0.10 inches thick and more preferably about 0.08 inches thick In one embodiment, the mounting device 20 desirably includes an elongated slot 32 that is formed in the flat plate and that extends between the top planar surface 24 and the bottom planar surface 26. The elongated slot 32 desirably extends along the leading edge 28 of the mounting device. As will be described in more detail herein, the elongated slot 32 is adapted to receive a securing flange projecting from a rear surface of a light fixture.

The mounting device 20 preferably includes a storage compartment 34 that is positioned below the flat plate 22. The storage compartment 34 preferably defines an enclosed area 36 extending between the leading edge 28 and the trailing edge 30 of the flat plate. In one embodiment, the storage compartment may have a rectangular or square shape. The storage compartment 34 desirably includes a front opening 38 accessible at the leading edge 28 of the flat plate 22 and a rear opening 40 accessible at the trailing edge 30 the flat plate 22.

Referring to FIG. 2, in one embodiment, the storage compartment 34 of the mounting device 20 desirably includes an outer side wall 42 and an inner side wall 44. The outer and inner side walls 42, 44 are preferably parallel to one another and extend between the leading and trailing edges 28, 30 of the flat plate 22. The storage compartment 34 also desirably includes a bottom wall 46 that extend between lower ends of the outer side wall 42 and the inner side wall 44. The bottom wall 46 also preferably extends between the leading and trailing edges 28, 30 of the flat plate 22. In one embodiment, the bottom wall 46 is bifurcated into a first part 48A and a second part 48B. The bifurcated wall 46 may include an elongated gap 50 that extends between the first and second parts 48A, 48B thereof.

As will be described in more detail herein, the storage compartment 34 is preferably adapted to receive electrical wiring that is used for connecting a light fixture with a power source. The electrical wiring is preferably stored in the enclosed area 36 defined by the outer side wall 42, the inner side wall 44 and the bottom wall 46. The enclosed area 36 protects the electrical wiring from the environment, such as the surrounding blocks and mortar layer in which the mounting device is disposed. The enclosed area 36 also provides a space for packing and/or storing the electrical wiring connected to a light fixture.

In one embodiment, as a securing flange on a rear of a light fixture is inserted into the elongated slot 32, any wiring forming a connection between the light fixture and a power source may be inserted into the enclosed area 36 of the storage compartment 34. Any slack or excess wiring forming the electrical connection with the light fixture may be folded and stored in the storage compartment.

Figure 4:
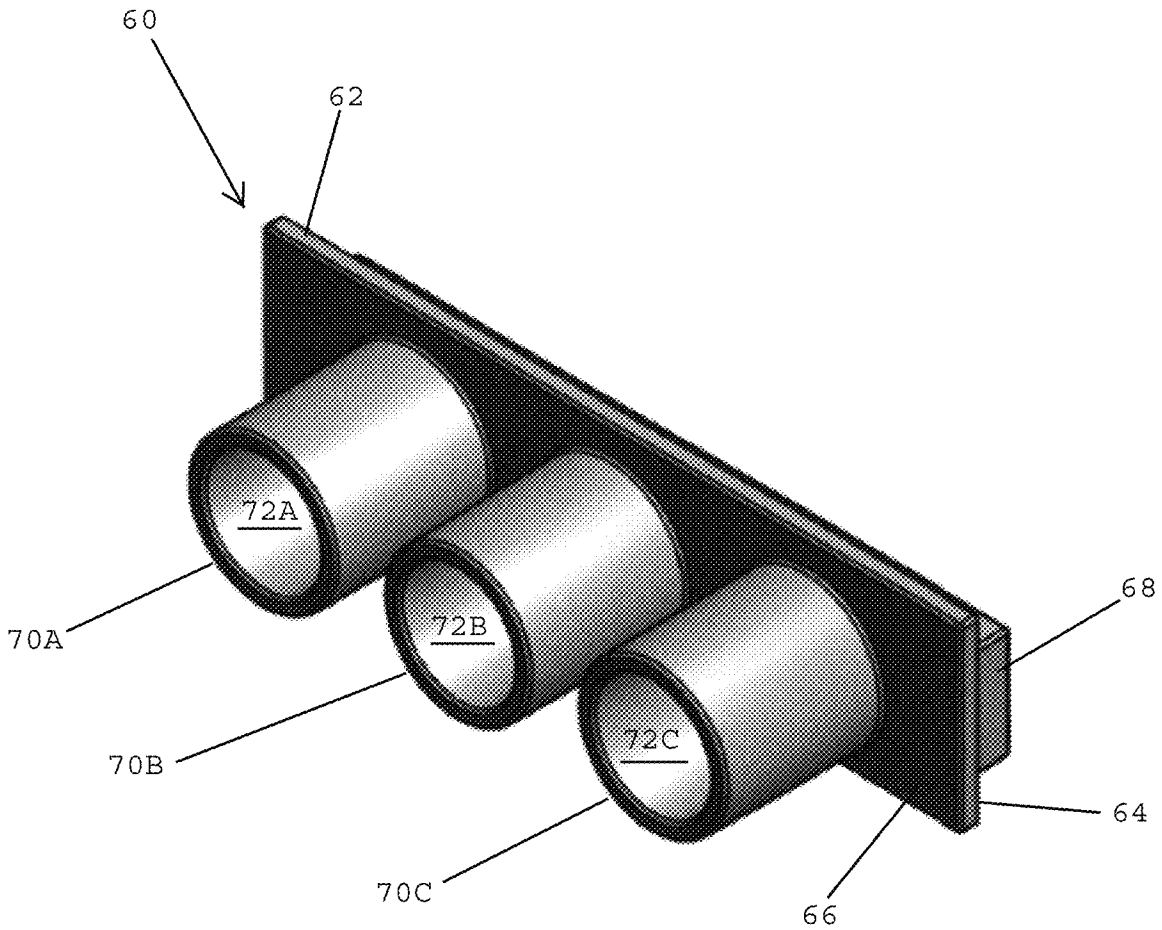
FIG. 4 is a perspective view of a conduit adapter adapted for being connected with the mounting device of FIGS. 1-3, in accordance with one embodiment of the present invention.

Referring to FIG. 4, in one embodiment, a conduit adapter 60 is designed for being connected with the rear opening of the storage compartment 34 shown in FIGS. 1-3. The conduit adapter 60 desirably includes a support plate 62 having a front face 64 and a rear face 66, and a plug 68 projecting from the front face 64 of the support plate 62. In one embodiment, the plug 68 is adapted for being inserted into the rear opening 40 of the storage compartment 34 (FIG. 3). In one embodiment, the conduit adapter is preferably bonded to the storage compartment, such as by using an adhesive, glue, or cement. The conduit adapter 60 desirably includes a set of tubes 70A, 70B, 70C having respective tube openings 72A, 72B, 72C. Each of the tube openings is adapted to receive a conduit for electrical wiring.

Figure 5:
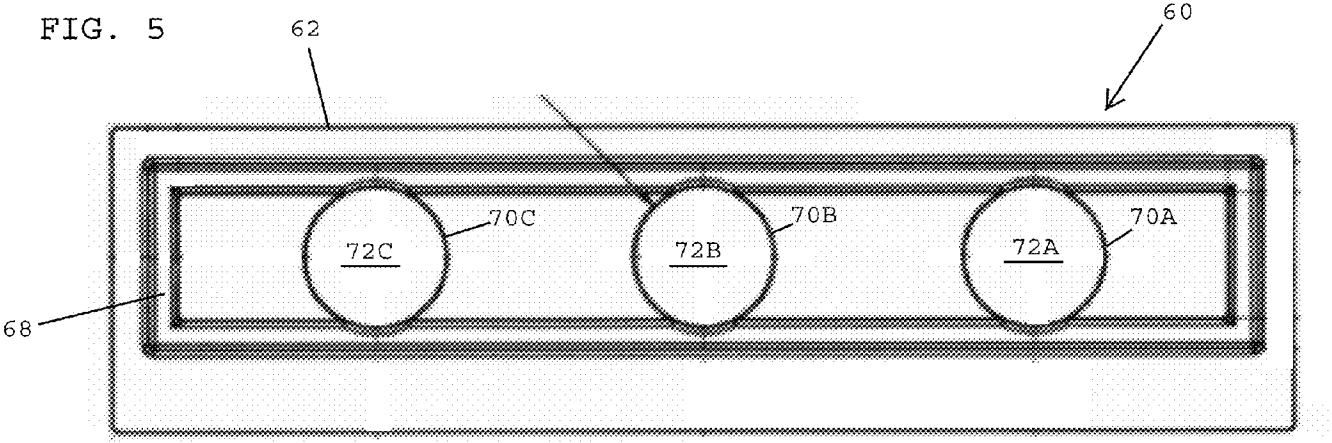
FIG. 5 is a front elevational view of the conduit adapter shown in FIG. 4.
Figure 6:
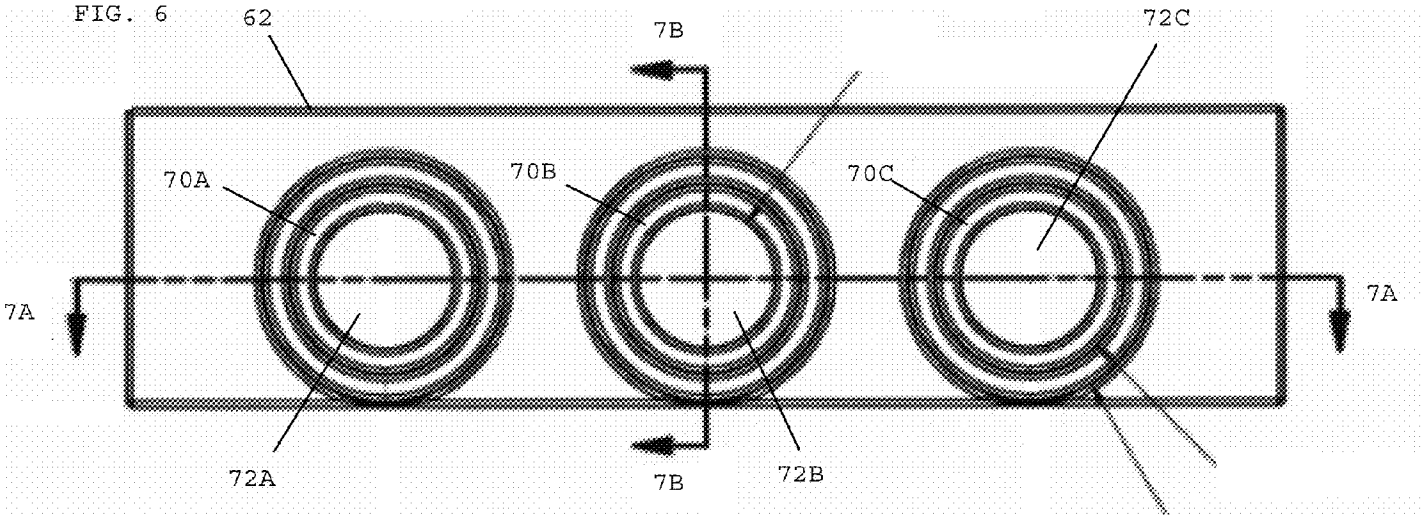
FIG. 6 is a rear elevational view of the conduit adapter shown in FIG. 4.

As shown in FIG. 5, the tube openings 72A-72C extend through the support plate 62 and the plug 68 for providing openings that extend through the conduit adapter 60. Referring to FIG. 6, in one embodiment, the three tubes 70A-70C project from the rear face 66 of the support plate 62.

Figure 7A:
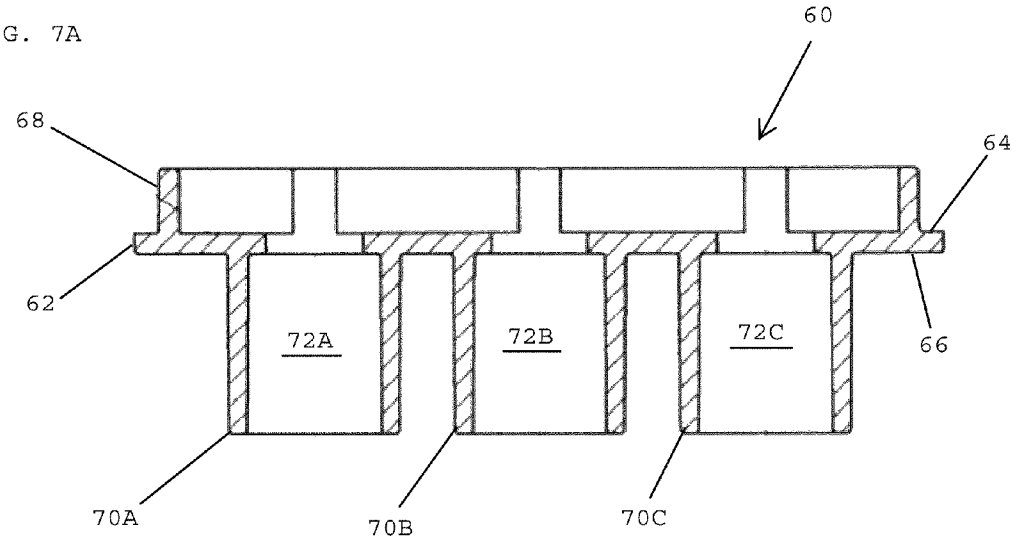
FIG. 7A is a cross-sectional view of the conduit adapter of FIG. 6 taken along line 7A-7A thereof.

Referring to FIG. 7A, the conduit adapter 60 preferably includes the support plate 62 having an inner face 64 and an outer face 66. The three tubes 70A-70C project from the rear face 66 of the support plate 62. The tubes define tube openings 72A-72C that extend through the support plate 62 and through the plug 68. The plug 68 has an outer dimension that preferably forms a frictional fit with the inner dimension of the rear opening 40 of the storage compartment 34 (FIG. 3).

Figure 7B:
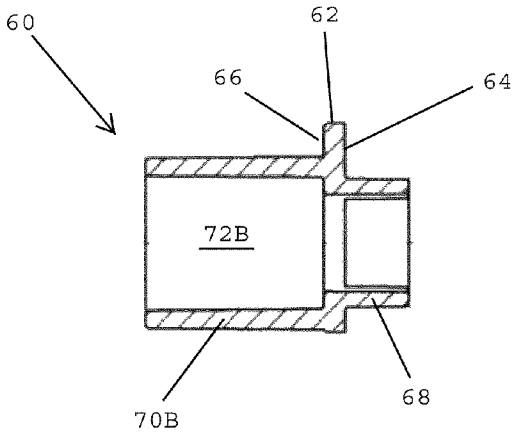
FIG. 7B is a cross-sectional view of the conduit adapter of FIG. 6 taken along line 7B-7B thereof.

FIG. 7B shows a cross-sectional view of the conduit adapter 60 taken along line 7B-7B of FIG. 6. The conduit adapter 60 includes the support plate 62 having an inner face 64 and an outer face 66. The tube 70B defines a tube opening 72B that extends through the support plate 62 and the plug 68. A conduit, such as a flexible conduit, may be coupled with the tube 70B, such as by inserting the conduit into the tube opening 72B, for providing access to an interior region of the storage compartment.

Figure 8A:
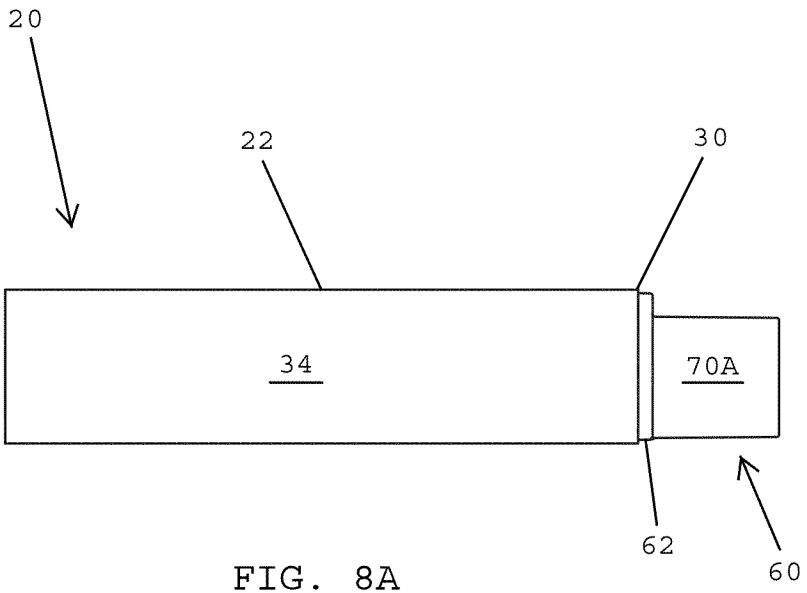
FIG. 8A is a right side elevational view of the conduit adapter of FIG. 4 joined with the mounting device of FIGS. 1-3.

Referring to FIG. 8A, in one embodiment, the conduit adapter 60 is assembled with the mounting device 20 by inserting the plug 68 (FIG. 7B) projecting from the support plate 62 into the rear opening of the storage compartment 34. The tube 70A projects rearwardly from the rear edge 30 of the flat plate 22.

Figure 8B:
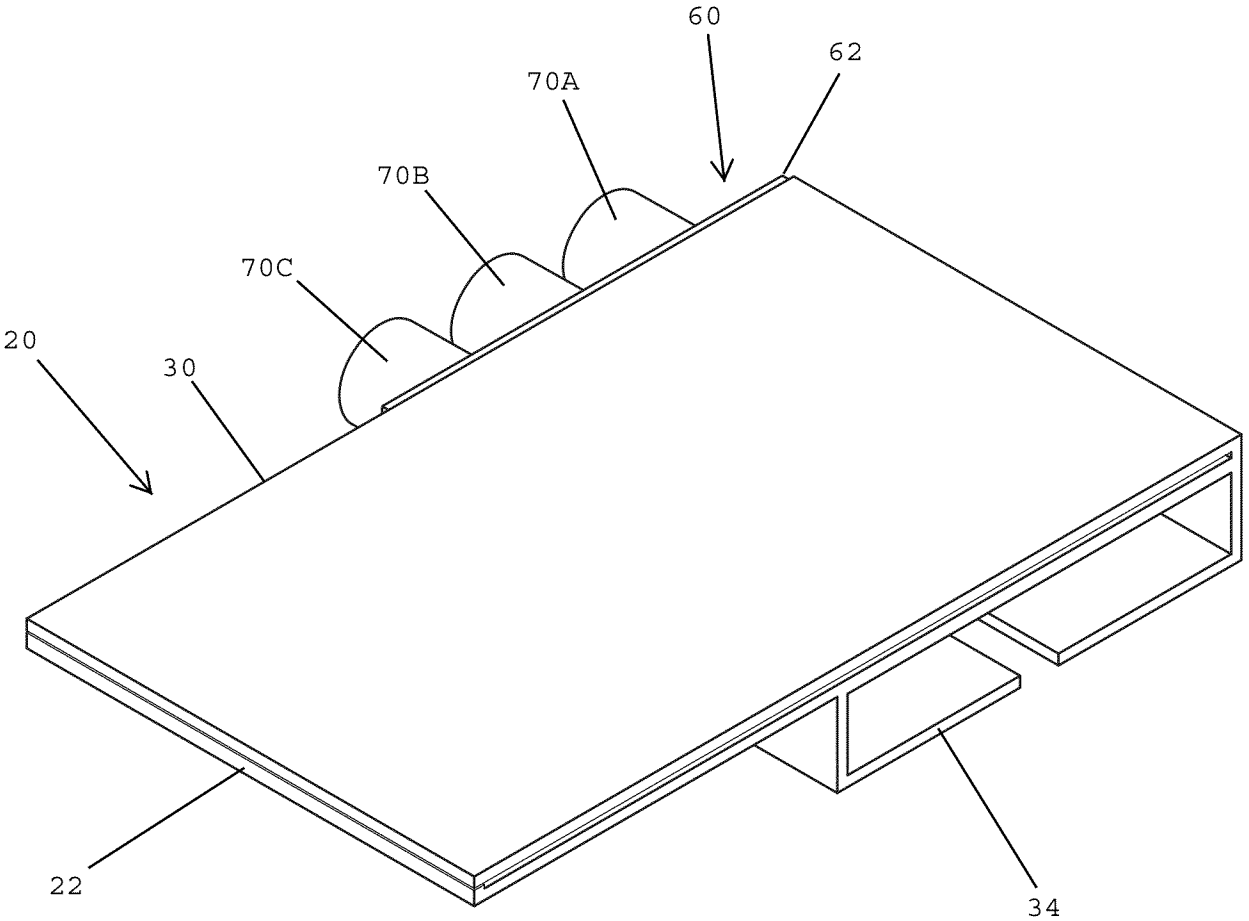
FIG. 8B is a top perspective view of the mounting device and conduit adapter of FIG. 8A.
Figure 8C:
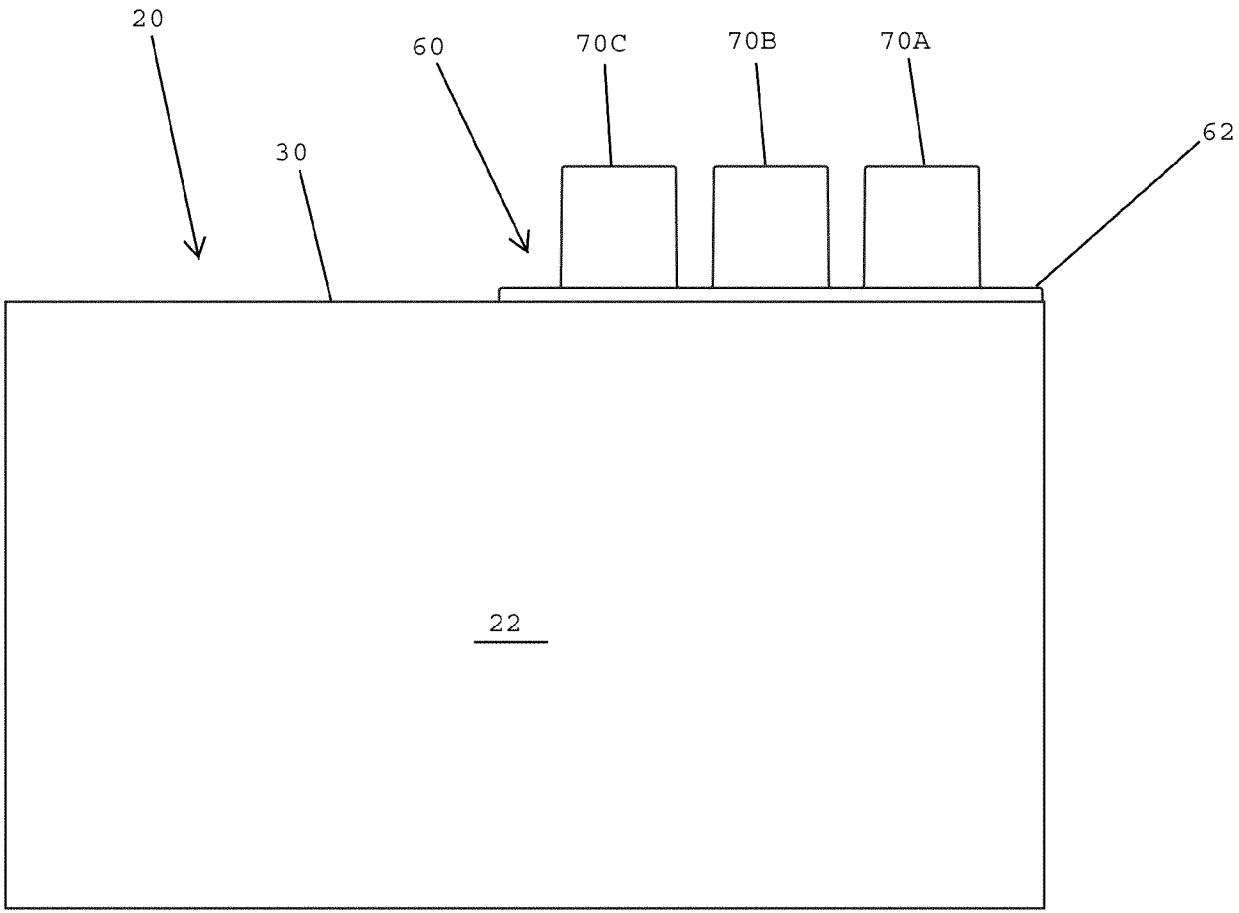
FIG. 8C is a top plan view of the mounting device and conduit adapter of FIGS. 8A and 8B.
Figure 8D:
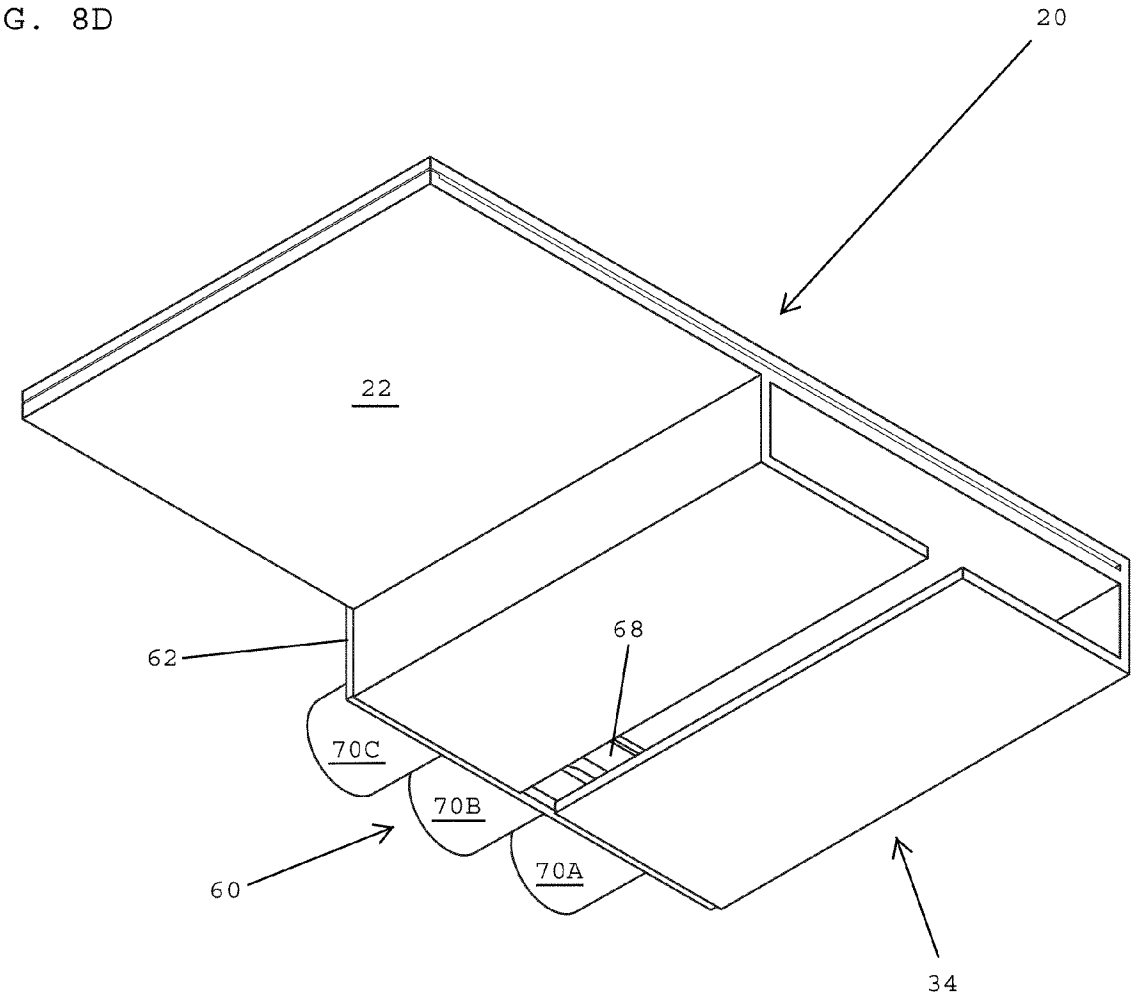
FIG. 8D is a bottom perspective view of the mounting device and conduit adapter of FIGS. 8A-8C.

Referring to FIGS. 8B-8D, after the conduit adapter 60 is secured to the rear opening of the storage compartment 34, the three tubes 70A-70C project rearwardly from the rear edge 30 of the flat plate 22. The three tubes 70A-70C provide openings into the storage compartment. Flexible conduits may be inserted into each of the tubes 70A-70C for providing a protected path for introducing electrical wiring into the storage compartment 34 of the mounting device 20.

Figure 9:
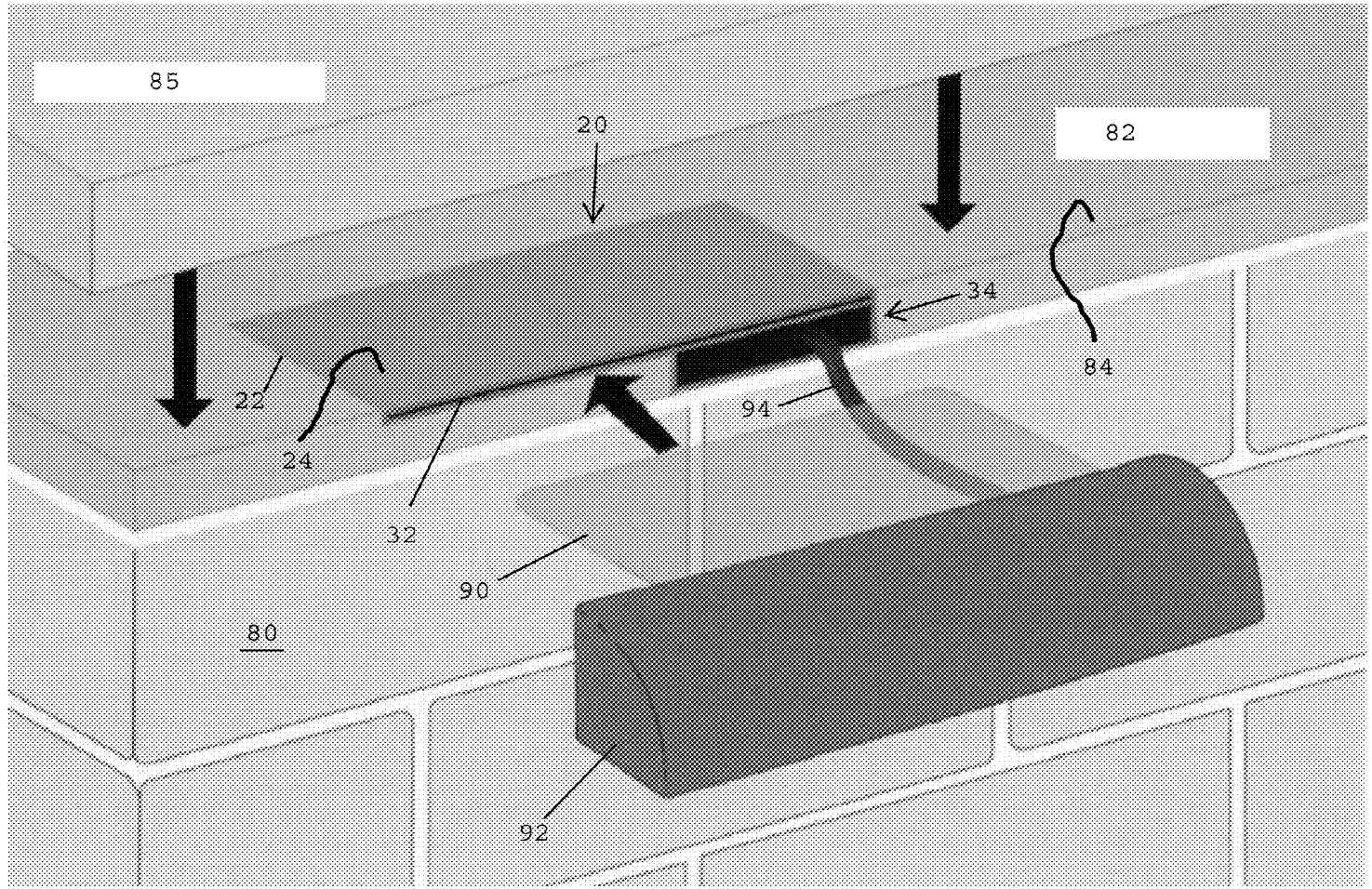
FIG. 9 shows a method of using a mounting device for securing a light fixture to a landscape wall, in accordance with one embodiment of the present invention.

Referring to FIG. 9, in one embodiment, the mounting device 20 described herein may be pre-positioned atop a landscape wall 80 having a wet mortar layer 82. The mounting device 20 may be embedded in the wet mortar layer 82 during construction of the wall so that the top planar surface 24 of the mounting device is aligned with the top surface 84 of the mortar layer 82. After curing, the top planar surface 24 of the flat plate 22 and the top surface 84 of the mortar layer 82 desirably lie in a common plane. A capstone 85 may be positioned over the mortar layer 82 and the mounting device 20 embedded therein.

Although only one mounting device 20 is shown in FIG. 9, the wall 80 may include two or more mounting devices spaced along the length of the mortar layer 82. Each mounting device 20 is preferably embedded within the mortar layer 82 so that the top planar surface 24 lies in a common plane with the top surface 84 of the mortar layer 82 and the storage compartment 34 underlies the flat plate 22. In addition, the mounting device is positioned so that the elongated slot 32 preferably extends along the front face of the wall 80.

In one embodiment, the elongated slot 32 is adapted to receive a securing flange 90 projecting from a rear of a light fixture 92. The securing flange 90 is adapted to slide into the elongated slot 32 for holding the light fixture 92 to the wall 80. The electrical wiring 94 interconnecting the light fixture 92 with a power source may be packed into the storage compartment 34. The storage compartment 34 preferably provides a protected area for minimizing exposure of the electrical wiring 94 to the surrounding environment (e.g. blocks, mortar, moisture, air).

Figure 10:
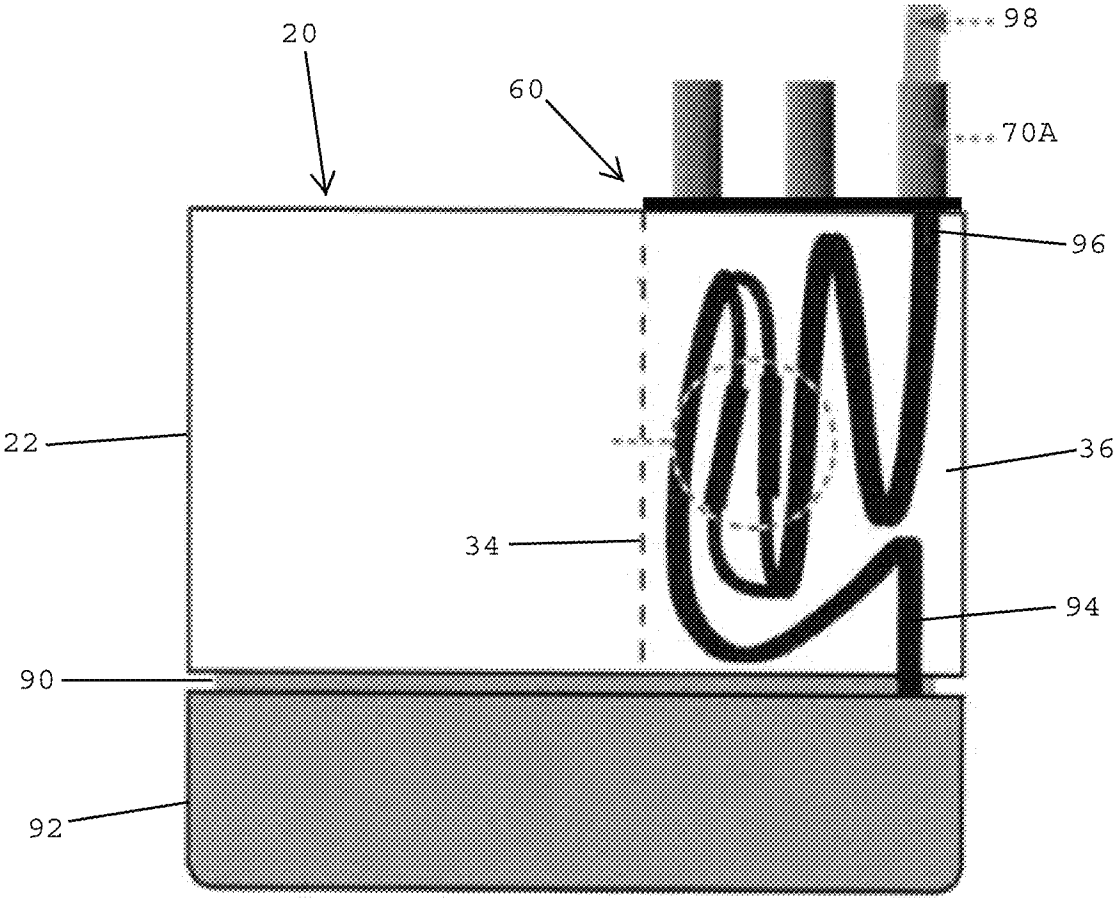
FIG. 10 shows a method of using a mounting device, conduit adapter and conduit for connecting a light fixture to a power source, in accordance with one embodiment of the present invention.

Referring to FIG. 10, in one embodiment, a light fixture 92 having a securing flange 90 is secured to the mounting device 20 by inserting the securing flange 90 into the elongated slot 32 extending along the front edge of the flat plate 22 (FIG. 9).

The electrical wiring 94, 96 used for electrically interconnecting the light fixture 92 with a power source is preferably folded and packed into the enclosed area 36 of the storage compartment 34. The first electrical wire 94 is permanently attached to the light fixture 92 and the second electrical wiring 96 is desirably fed through the first tube 70A of the conduit adapter 60.

In one embodiment, a flexible conduit 98 provides a protected passageway for the second electrical wiring 96. The flexible conduit 98 may be pre-positioned during construction of a wall and prior to coupling the light fixture 92 to the second electrical wiring 96. The flexible conduit 98 preferably remains in place after construction of the wall and installation of the light fixture 92. If it is necessary to repair and/or replace the light fixture 92 or the electrical wiring 94, 96, the second electrical wiring 96 may be withdrawn through the flexible conduit 98 and replacement electrical wiring advanced through the conduit 98 for passing through the tube 70A and into the enclosed area 36 of the storage compartment 34.

Although the present invention is not limited by any particular theory of operation, it is believed that utilizing a flexible conduit 98 will enable replacement wiring 94 to be readily passed through the conduit 98 and into the enclosed area 36 of the storage compartment 34, thereby facilitating replacement, repair and/or maintenance of the electrical wiring and the light fixture.

After a period of time, it may be necessary to remove the light fixture 92 from the mounting device 20 for repairing and maintaining the light fixture, or replacing the light fixture with a new light fixture. In those instances, the light fixture 92 may be pulled away from the mounting device 20 so that the securing flange 90 may be retracted from the elongated slot extending along the leading edge of the flat plate 22. As the light fixture 92 is pulled away from the mounting device 20, the electrical wiring 94 is pulled through the first opening of the storage compartment 34, as shown in FIG. 9. After any necessary maintenance and/or repairs have occurred, the electrical wiring 94 may be reconnected with the light fixture 92 and the electrical wiring inserted back inside the storage compartment 34.

Figure 11:
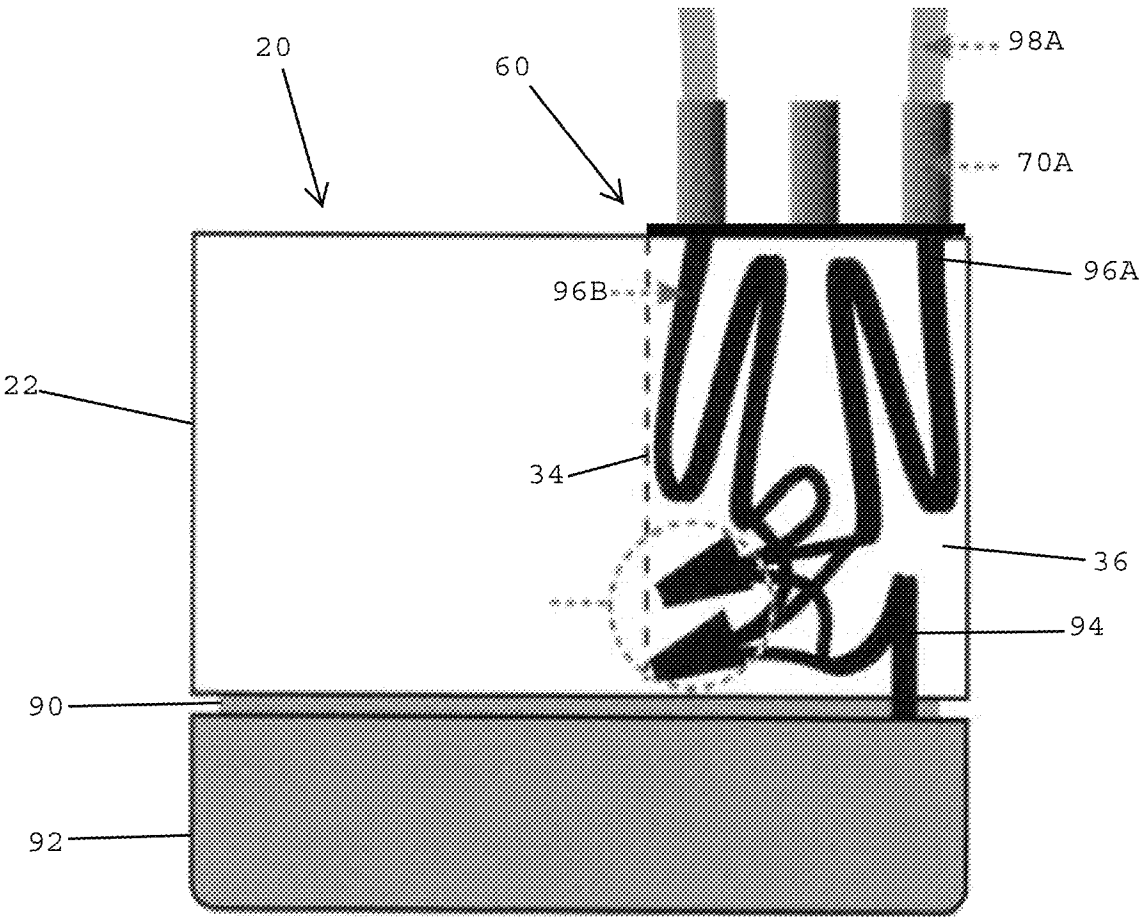
FIG. 11 shows a method of using a mounting device, conduit adapter and conduit for connecting a light fixture with a power source, in accordance with another embodiment of the present invention.

Referring to FIG. 11, in one embodiment, two electrical wires 96A, 96B may be connected with the light fixture 92. The first electrical wire 96A may pass through a first tube 70A and a first conduit 98A for being connected with the electrical wire 94 of the light fixture 92. The second electrical wire 96B may pass through a third tube 70C and a third conduit 98C for being connected with the electrical wire 94 of the light fixture 92. Any slack in the electrical wiring 94, 96A, 96B may be folded for storage within the storage compartment.

Figure 12:
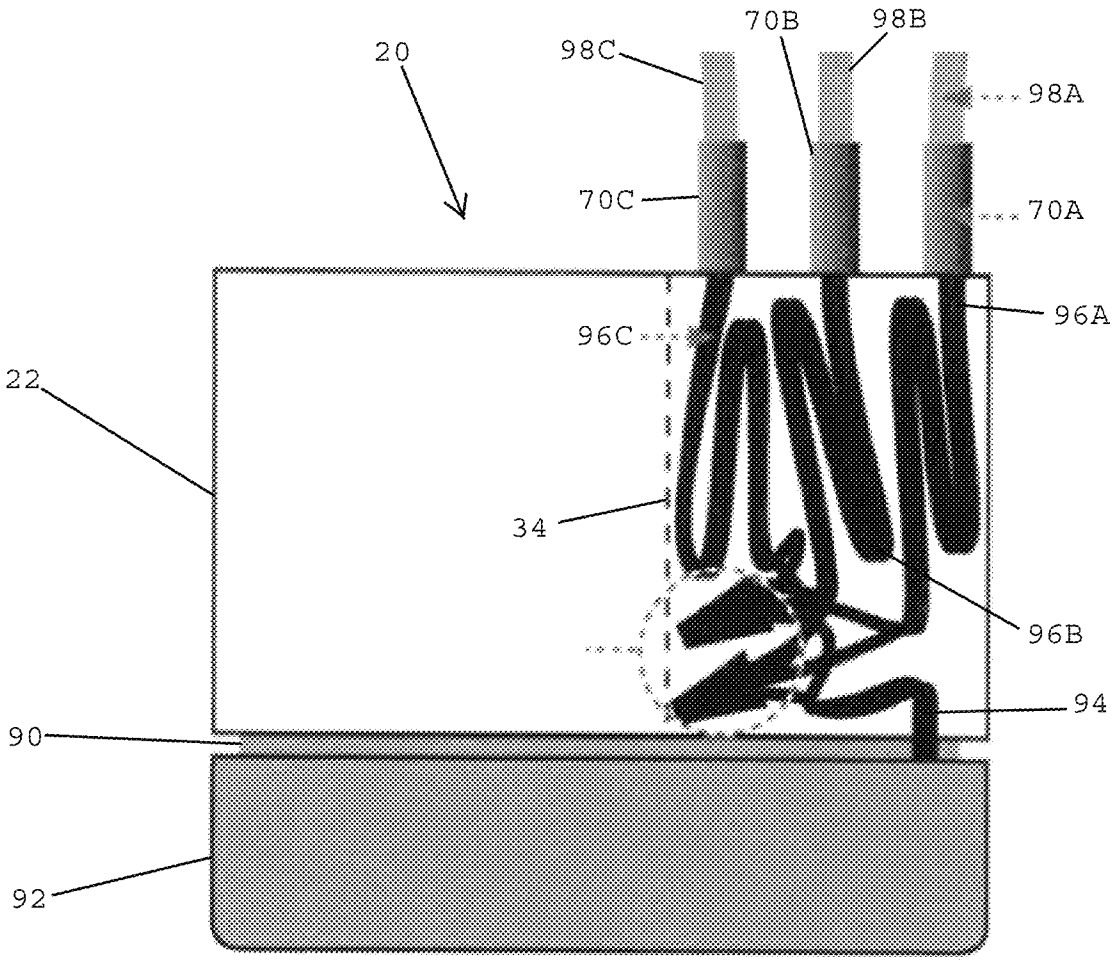
FIG. 12 shows a method of using a mounting device, conduit adapter and conduit for connecting a light fixture with a power source, in accordance with another embodiment of the present invention.

Referring to FIG. 12, in one embodiment, three electrical wires 96A-96C are coupled with the electrical wire 94 of the light fixture 92. The first electrical wire 96A passes through the first flexible conduit 98A and the first tube 70A. The second electrical wire 96B passes through the second tube 70B and the second flexible conduit 98B. The third electrical wire 96C passes through the third tube 70C and the third flexible conduit 98C. The ends of the electrical wires 96A-96C are electrically interconnected with electrical wiring 94 projecting from the rear and of the light fixture 92. After the electrical connection has been made, the electrical wiring is positioned within the storage compartment 34 for being stored within a protected environment. The securing flange 90 on the light fixture 92 is preferably inserted into the elongated slot at the leading edge of the plate 22 of the mounting device 20 for securing the light fixture to the mounting device.

Figure 13:
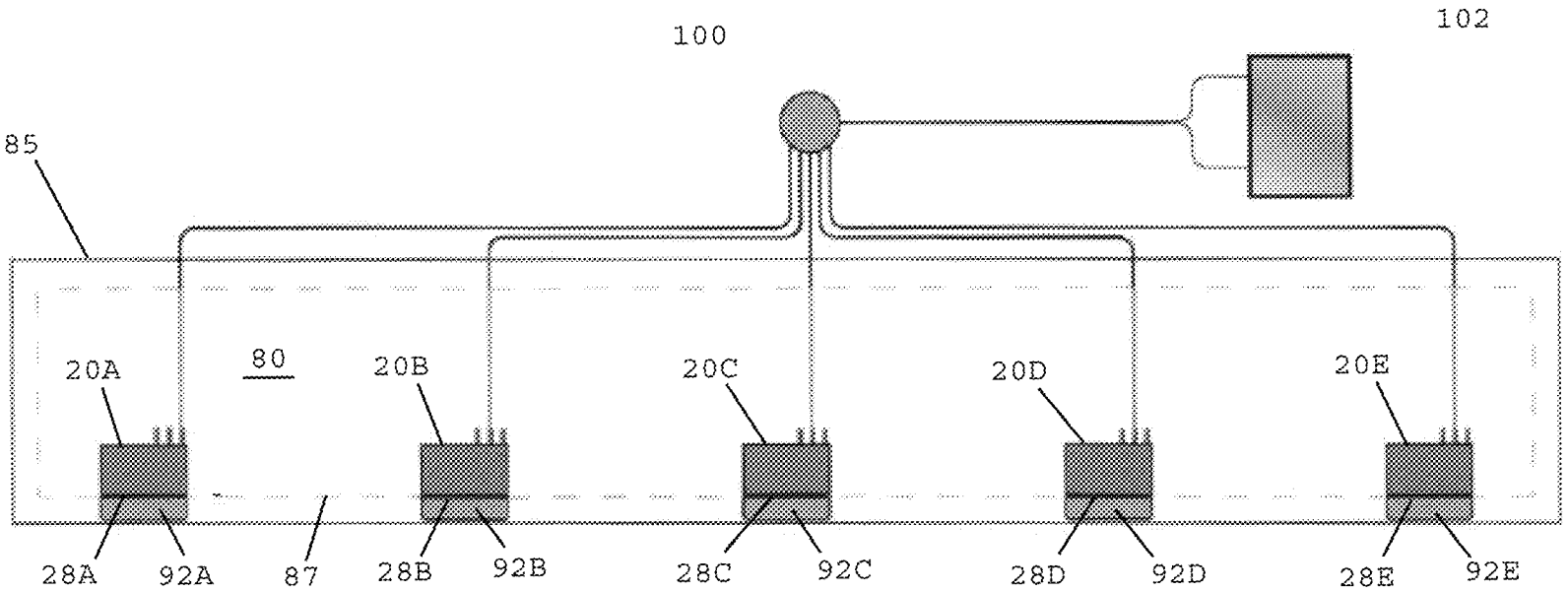
FIG. 13 shows a first wiring pattern for connecting landscape wall light fixtures with a transformer, in accordance with one embodiment of the present embodiment.

Referring to FIG. 13, in one embodiment, a plurality of light fixtures 92A-92E may be positioned along the length of a landscape wall 80. The light fixtures are preferably evenly spaced from one another along the length of the wall. In one embodiment, the mounting devices 20A-20E are spaced along the length of the wall 80 so that the leading edges 28A-28E of the respective mounting devices are aligned with the front face 87 of the wall 80. The mounting device may be embedded in a mortar layer 82 (FIG. 9) of the wall 80. Flexible conduit 98 extends through the mortar layer. Electrical wiring is preferably passed through the conduit 98 for connecting the respective mounting devices 20A-20E with a junction 100, which, in turn, is connected with a transformer 102. A capstone 85 may be placed atop the mortar layer and the mounting devices 20A-20E.

After the electrical wiring has been passed through the flexible conduit 98 for reaching the storage compartments of each of the mounting devices 20A-20E, the electrical wiring passed through the conduit may be electrically interconnected with the wiring permanently attached to the respective light fixtures 92A-92E. Any slack remaining in the electrical wiring may be folded, packed and/or inserted into the storage compartments of the respective mounting devices, as shown and described above in FIGS. 10-12.

Figure 14:
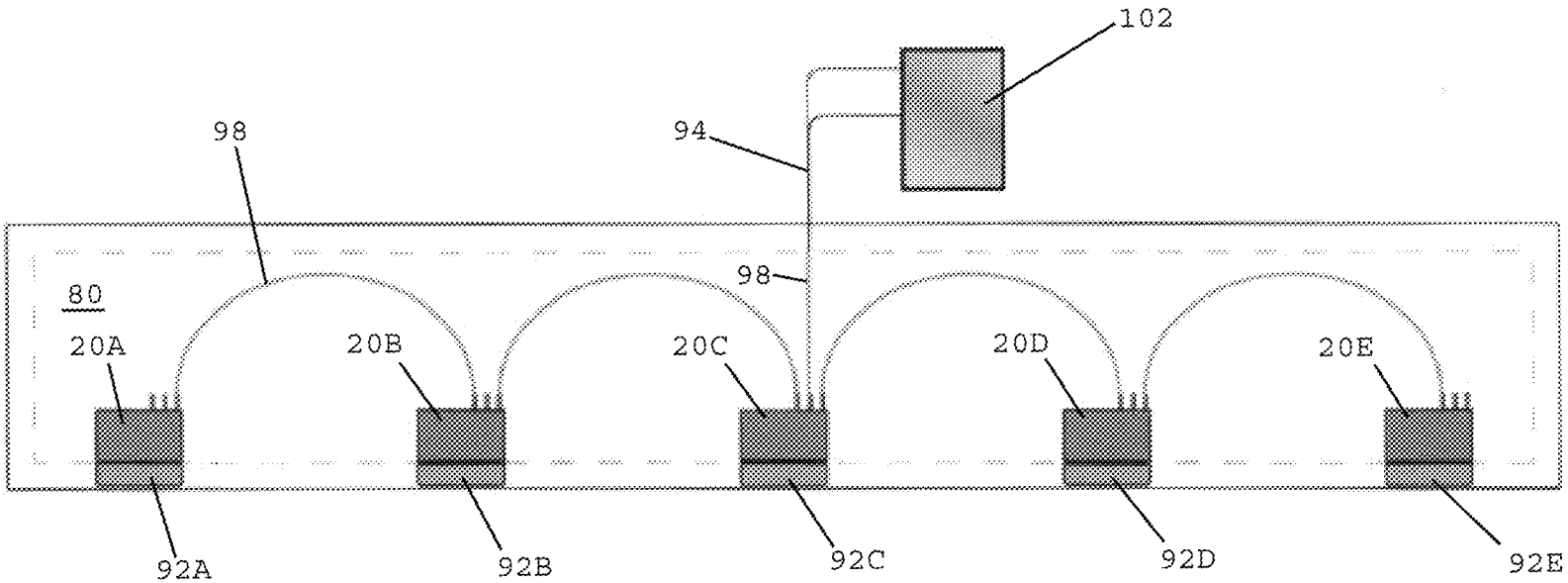
FIG. 14 shows a second wiring pattern for connecting landscape wall light fixtures with a transformer, in accordance with one embodiment of the present invention.

FIG. 14 shows another embodiment whereby light fixtures 92A-92A are spaced along the length of a masonry wall. A transformer 102 is electrically connected with a centrally-located mounting device 20C via electrical wiring 94 that passes through a conduit 98. The mounting devices 20A-20C are interconnected via flexible conduit 98 that extends laterally between the adjacent mounting devices 20A-20C. Electrical wiring may be passed through the conduit(s) 98 for providing electrical power to the light fixtures 92A-92E.

Figure 15:
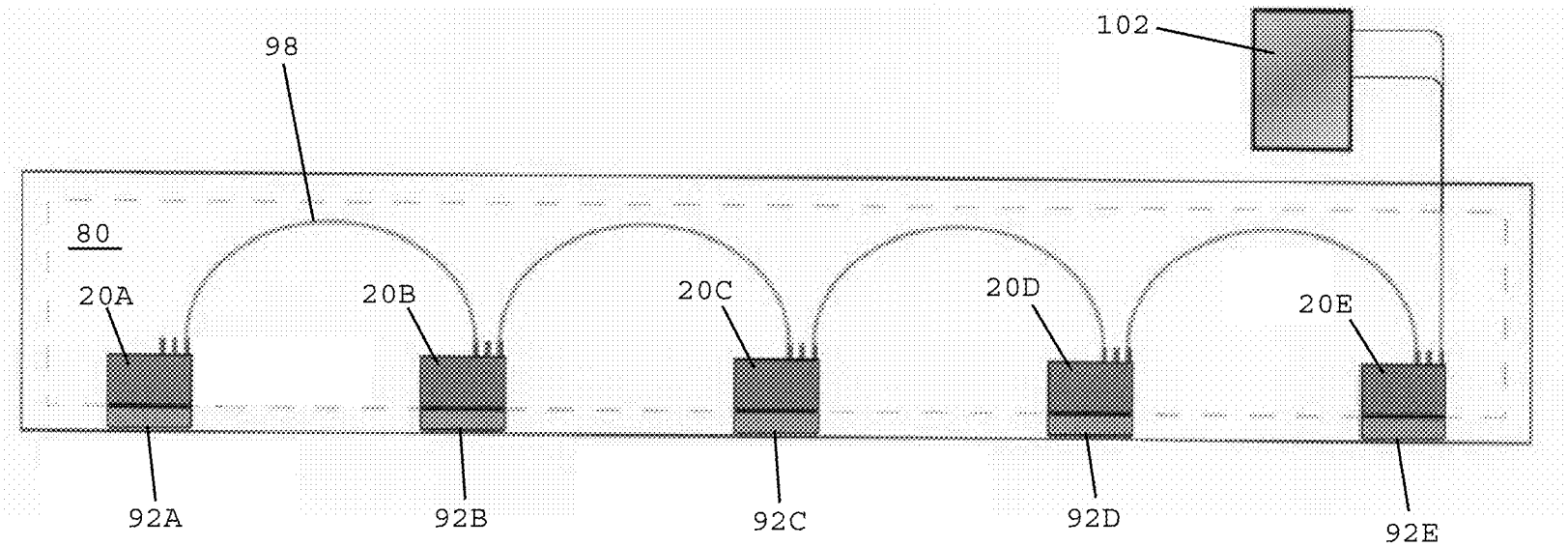
FIG. 15 shows yet another wiring pattern for connecting landscape wall light fixtures with a transformer, in accordance with one embodiment of the present invention.

FIG. 15 shows another wiring methodology having a daisy chain pattern. Flexible conduits 98 extend through a mortar layer and between the spaced mounting devices 20A-20E. Electrical wiring is passed through the flexible conduits 98 for being electrically interconnected with the light fixtures 92A-92E. Operation of the light fixtures 92A-92E is controlled by a transformer 102 that is electrically interconnected with the fifth light fixture 92E.

Figure 16:
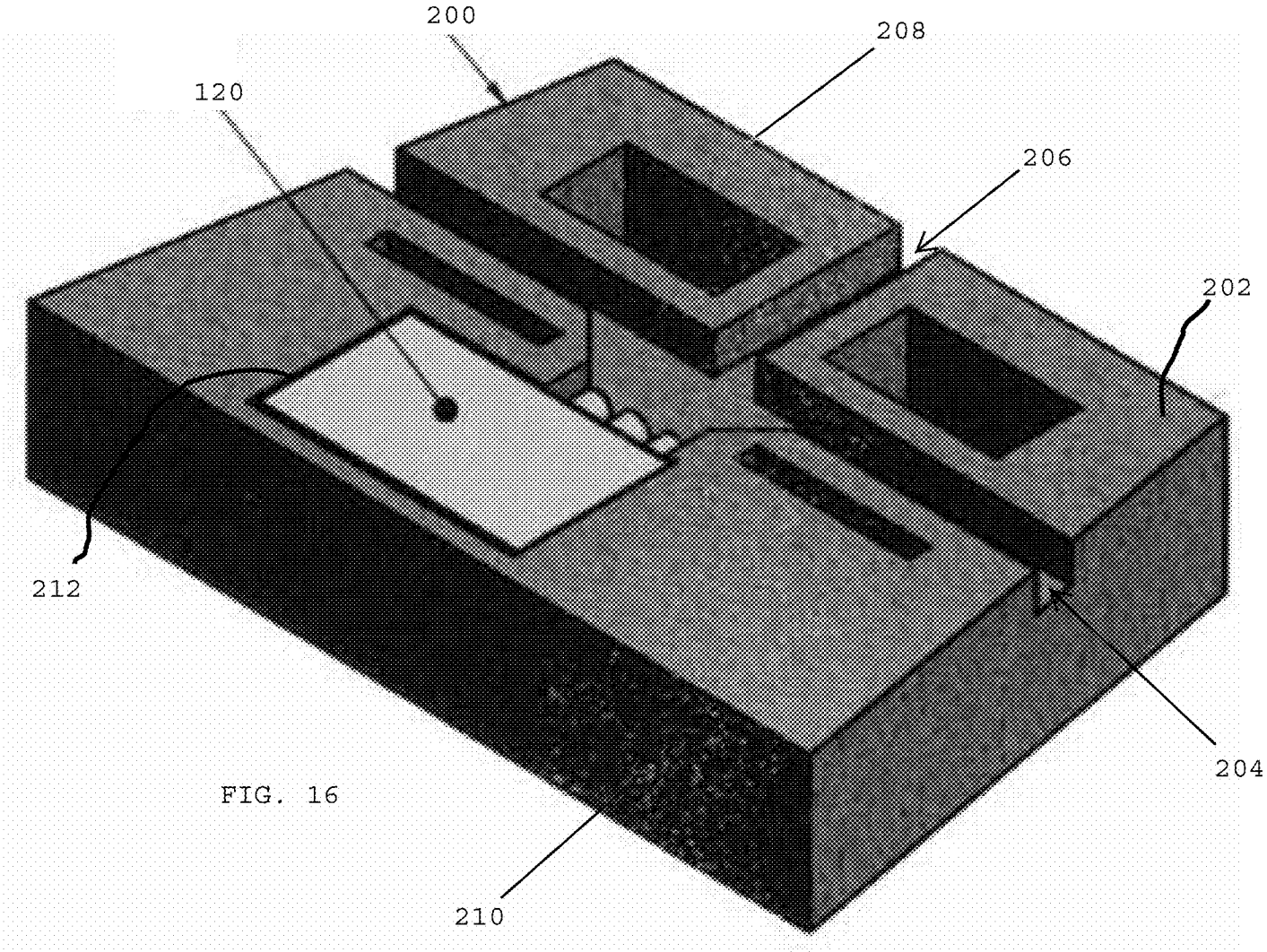
FIG. 16 shows a perspective view of an engineered block used for constructing a landscape wall including a receptacle adapted to receive a mounting device for a light fixture, in accordance with one embodiment of the present invention.

The mounting devices and systems disclosed herein may also be used in landscape walls made of engineered blocks. Referring to FIG. 16, in one embodiment, a mounting device 120 may be disposed within an engineered block 200 having a top surface 202 with a first channel 204 extending along the length of the block 200. The first channel 204 is adapted to receive conduit for electrical wiring. When a plurality of blocks 200 are assembled side-by-side to form row of a wall, the first channel 204 preferably extends along the length of the wall. The first channel 204 desirably enables conduit to be extended along the length of a landscape wall for directing electrical wiring through the conduit and along the length of the wall.

The engineered block 200 includes a second channel 206 that extends from a rear face 208 of the block toward a front face 210 of the block 200. The second channel 206 is also adapted to receive conduit for electrical wiring. The engineered block 200 also desirably includes a central cavity 212 formed in the top surface 202 that is adapted to receive the mounting device 120.

Figure 17:
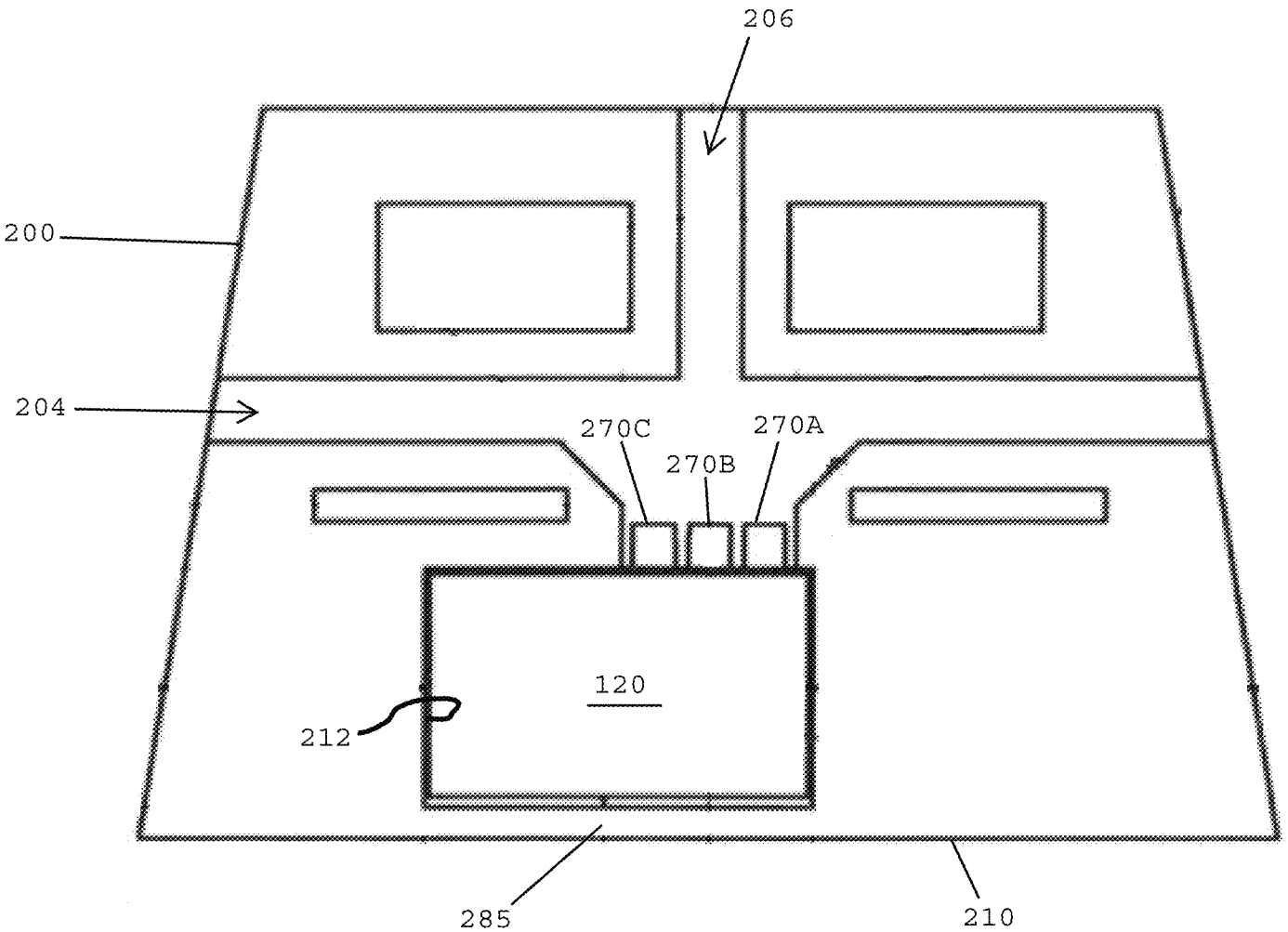
FIG. 17 shows a top plan view of the engineered block and mounting device shown in FIG. 16.

Referring to FIG. 17, the mounting device 120 is preferably inserted into the central cavity 212 of the engineered block 200. The tubes 270A-270C of the conduit adapter 260 preferably extend into an area intersected by the first channel 204 and the second channel 206. The flexible conduit (not shown) may pass through the first and second conduits 204, 206 and into the tubes 270A-270C for providing a path for electrical wiring to be advanced into the mounting device 120. When it is desired to secure a light fixture to the mounting device 120, a front face section 285 of the engineered block 200, located at the front face 210 of the block 200, may be removed for exposing the elongated slot formed in the flat plate and the front opening of the storage compartment (FIG. 3).

In one embodiment, an engineered block is supplied from a block manufacturer with a recessed cavity adapted to receive a mounting device. After an installer arranges the engineered blocks at a desired height and spacing, the installer may break away some of the material on some of the blocks. The material may be broken away, such as by using a chisel, saw, or other tool of the trade, for exposing the mounting device and enabling the leading edge of the mounting device to be aligned with the front face of the wall. The mounting devices may be secured to the blocks using adhesive materials commonly used in the wall construction industry.

In one embodiment, a wall may be built using the engineered blocks shown and described above in FIGS. 16 and 17. Some of the engineered blocks may have the mounting devices pre-installed therein (e.g. at the factory). Thus, two types of engineered block may be provided—a first type of block having a mounting device and a second type of block having no mounting device. The wall may be built with the first type of block interspersed between the second type of block for spacing light fixtures along the length and/or height of the wall.

In one embodiment, a contractor may break away the front face section 285 of an engineered block 200 when it is desired to position a light fixture in the block. If a light fixture will not be secured to the engineered block, then the front face section 285 will not be removed. In one embodiment, a block manufacturer preferably includes the front face section 285 in each block that is manufactured and sold. When constructing a wall using the engineered blocks 200, an installer can modify any of the blocks by removing the front face section 285, which enables the contractor to position a mounting device within the block for securing a light fixture to the block.

Figure 18A:
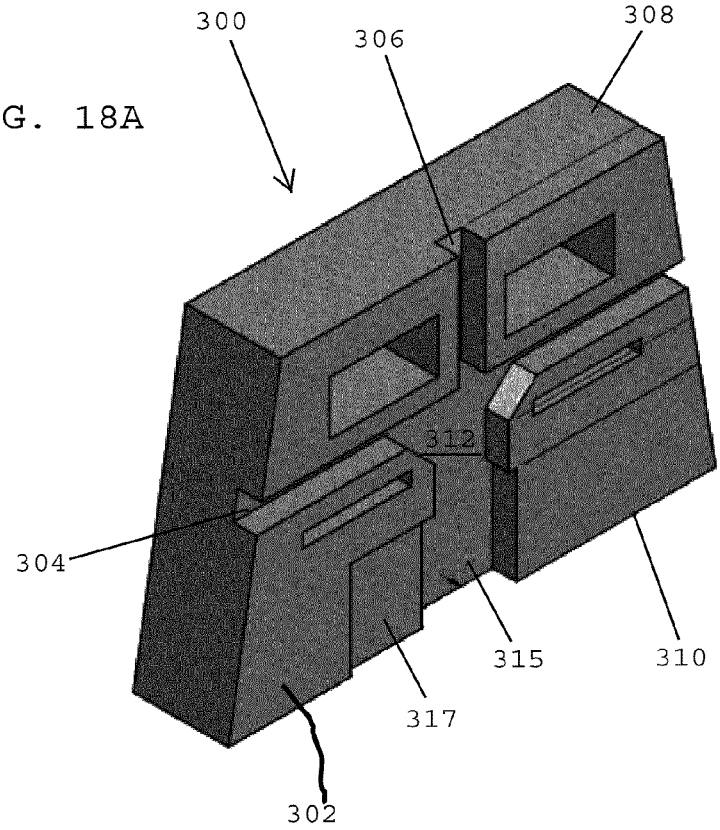
FIG. 18A shows a perspective view of an engineered block used for constructing a landscape wall, in accordance with another embodiment of the present invention.

Referring to FIG. 18A, in one embodiment, an engineered block 300 has a top surface 302 with a first channel 304 extending along the length of the block 300. The first channel 304 is preferably adapted to receive conduit for electrical wiring. When a plurality of engineered blocks 300 is assembled side-by-side to form a row of a wall, the first channel 304 preferably extends along the length of the wall so that conduit and/or electrical wiring may be extended along the length of the wall. The engineered block 300 desirably includes a second channel 306 that extends from a rear face 308 toward a front face 310 of the block. The second channel 306 is also adapted to receive conduit for running electrical wiring through the block. The engineered block 300 also preferably includes a central cavity 312 formed in the top surface 302 that is adapted to receive a mounting device. The central cavity is preferably located at the intersection of the first and second channels 304, 306. The central cavity 312 preferably includes a first shelf 315 adapted to receive a storage compartment of a mounting device and a second shelf 317 that is shallower than the first shelf and that is adapted to receive a flat plate of a mounting device, as will be described in more detail below.

Figure 18B:
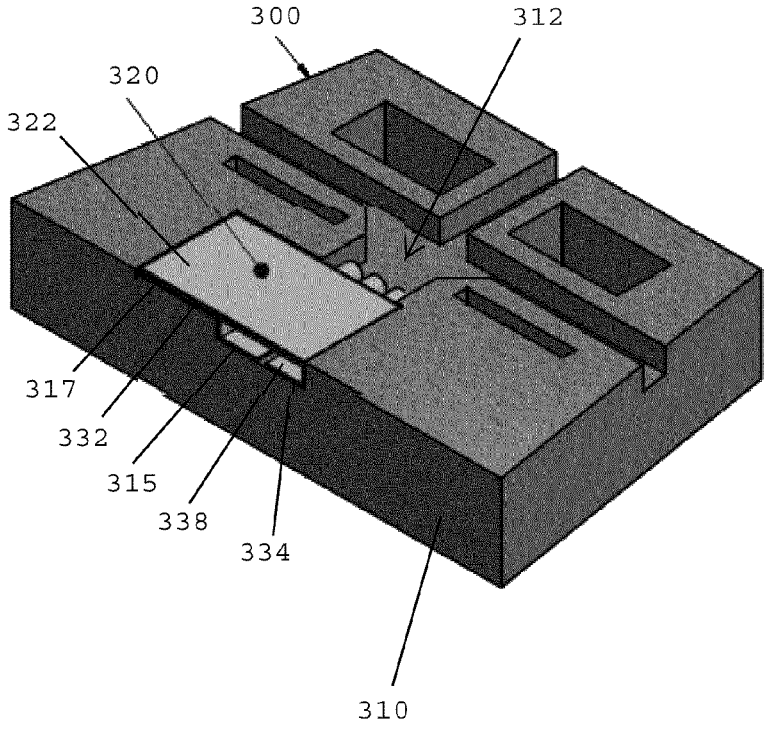
FIG. 18B shows a perspective view of the engineered block of FIG. 18A with a mounting device secured thereto.

Referring to FIG. 18B, in one embodiment, a mounting device 320 is seated in the central cavity 312 of the engineered block 300. The mounting device 320 is adapted to secure a light fixture to the engineered block. The storage compartment 334 of the mounting device 320 is seated within the first shelf 315 of the central cavity 312, and the flat plate 322 is seated within the second shelf 317 of the central cavity. When the mounting device 320 is seated within the central cavity 312, the front opening 338 of the storage compartment 334 and the elongated slot 332 are accessible at the front face 310 of the engineered block 300. The elongated slot 332 is adapted to receive the securing flange of a light fixture, and the storage compartment is adapted to receive electrical wiring attached to the light fixture.

Figure 18C:
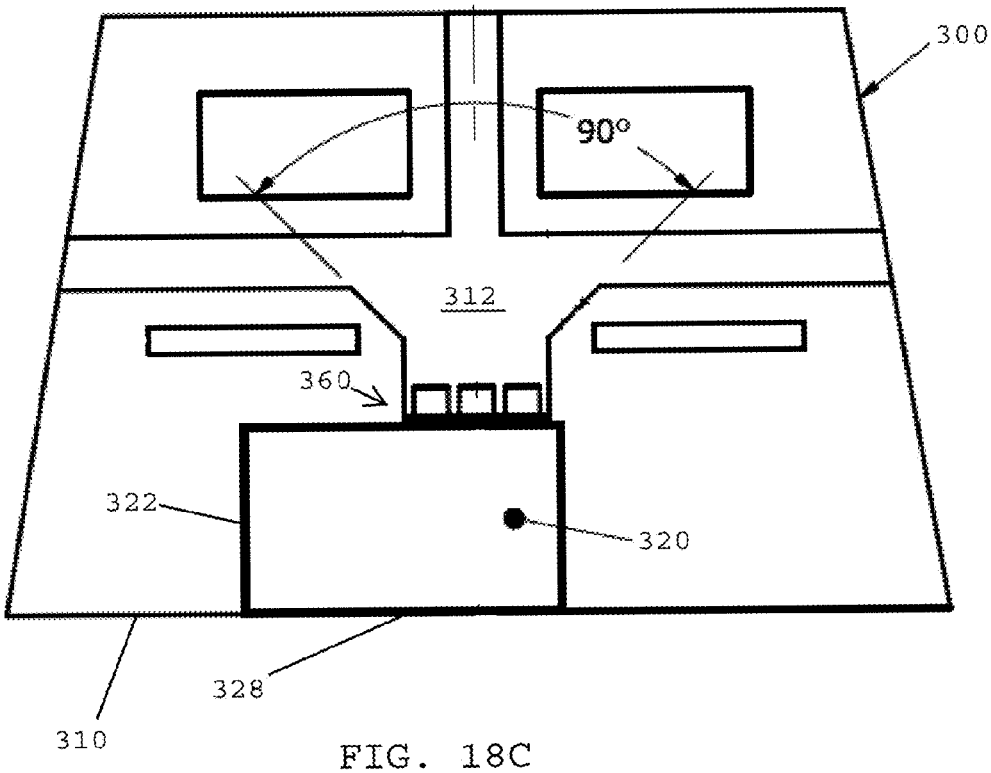
FIG. 18C shows a top plan view of the engineered block and mounting device shown in FIG. 18B.

FIG. 18C shows the mounting device 320 seated within the central cavity 312 of the engineered block 300. The leading edge 328 of the flat plate 322 extends along and is aligned with the front face 310 of the block 300. The mounting device includes the conduit adapter 360 having tubes 370A-370D adapted to receive conduit, which, in turn, receive electrical wiring for providing power to the mounting device.

Figure 18D:
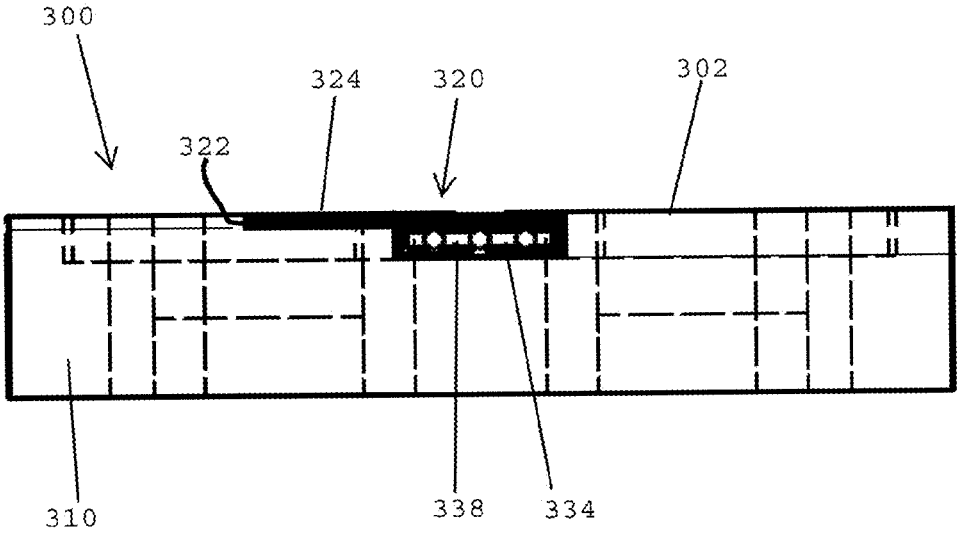
FIG. 18D shows a front elevational view of the engineered block and mounting device shown in FIGS. 18B and 18C.

FIG. 18D shows a front elevational view of the engineered block 300 with the mounting device 320 seated within the central cavity 312 (FIG. 18C). The mounting device 320 includes the flat plate 322 having a top planar surface 324 that lies in a common plane with the top surface 302 of the engineered block 300. The front opening 338 of the storage compartment 334 is accessible at the front face 310 of the engineered block. Any electrical wiring used for connecting a light fixture with the mounting device 320 may be positioned within the storage compartment 334. A securing flange on the light fixture is preferably inserted into the elongated slot accessible at the front face of the flat plate 322, as described above.

Figure 19A:
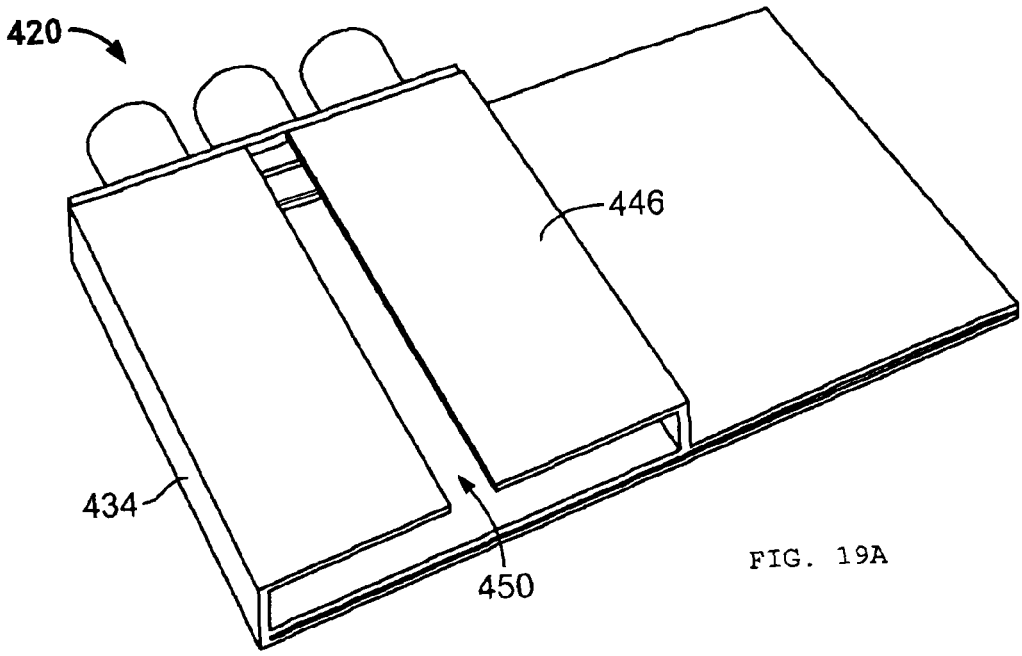
FIGS. 19A-19F show a method of using a mounting device for a light fixture, in accordance with one embodiment of the present invention.
Figure 19B:
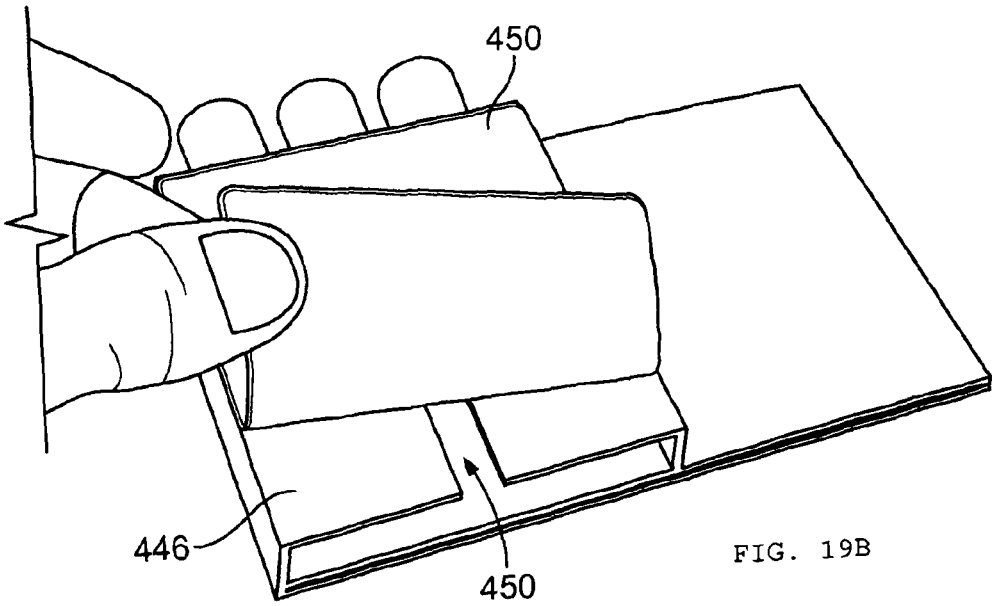
Figure 19C:
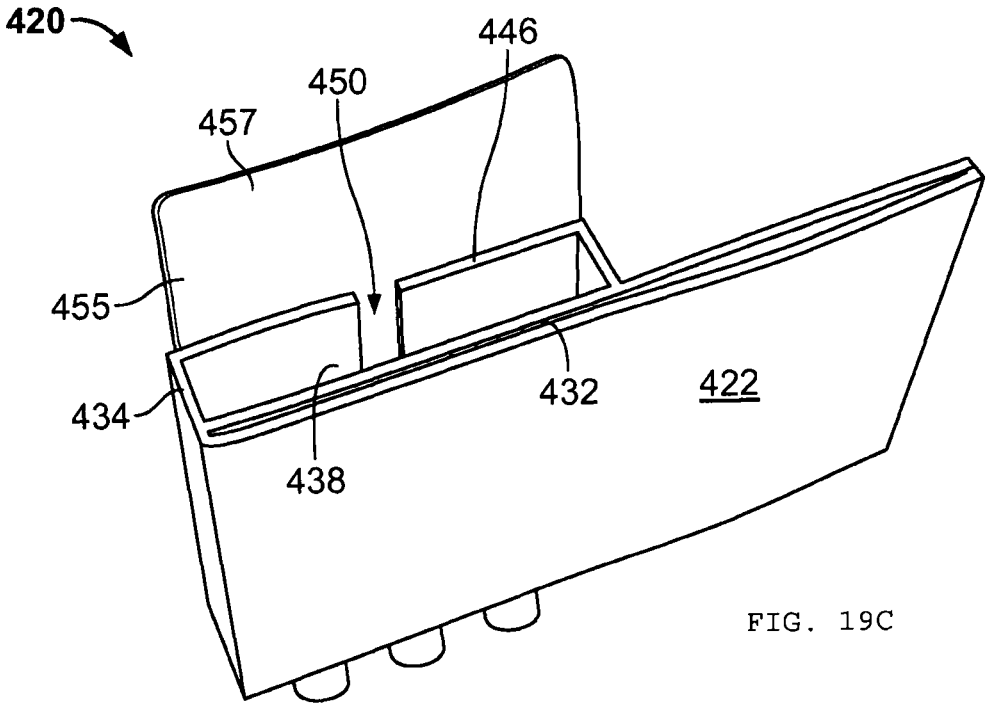
Figure 19D:
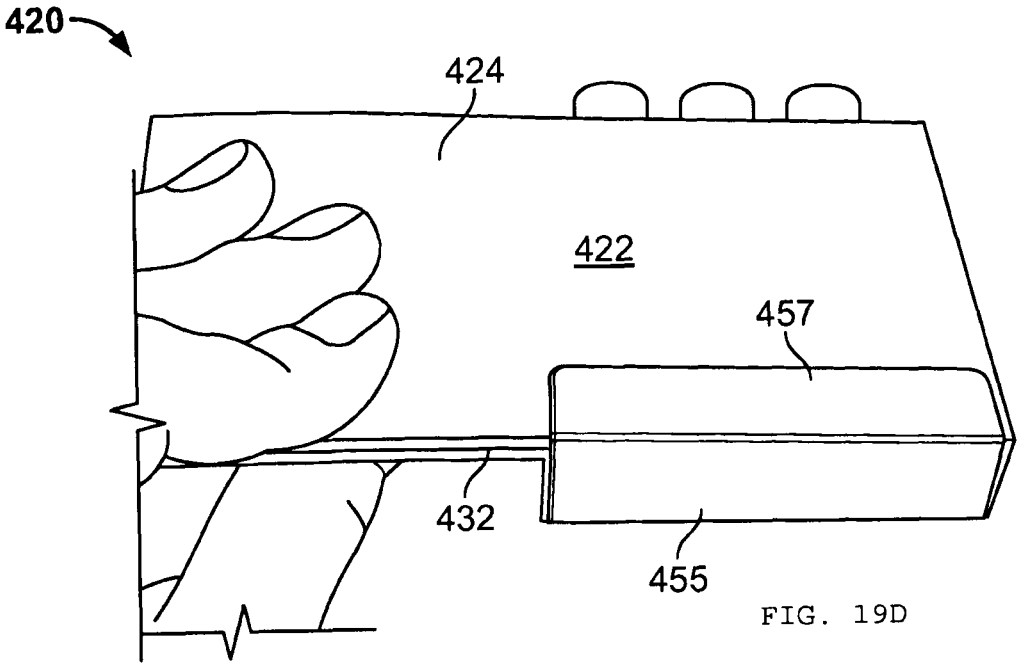

In one embodiment, a label may be used for sealing the storage compartment and the elongated slot in the flat plate from construction debris. The label may bear the manufacturer's name or logo, and/or instructions for utilizing the light fixture mounting system. Referring to FIG. 19A, in one embodiment, a mounting device 420 preferably includes a storage compartment 434 having a bottom wall 446 and an elongated gap 450 formed in the bottom wall 446. Referring to FIGS. 19B and 19C, an adhesive label 455 may be placed over the bottom wall 446 for sealing the elongated gap 450 so as to prevent concrete and other construction debris from entering the enclosed area 436 of the storage compartment 434. Referring to FIGS. 19C and 19D, the front flap 457 of the adhesive label 455 may be wrapped around the front of the mounting device 420 for covering the front opening 438 of the storage compartment 434. The free end of the front flap 457 may be adhered to the top planar surface 424 of the flat plate 422 for protecting the storage compartment and at least a portion of the elongated slot 432 formed in the flat plate 422. The front flap 457 of the adhesive label 455 may be opened and closed as necessary by peeling the front flap 457 away from the flat plate 422 and later re-adhering the front flap 457 of the adhesive label 455 to the top planar surface 424 of the flat plate 422.

Figure 19E:
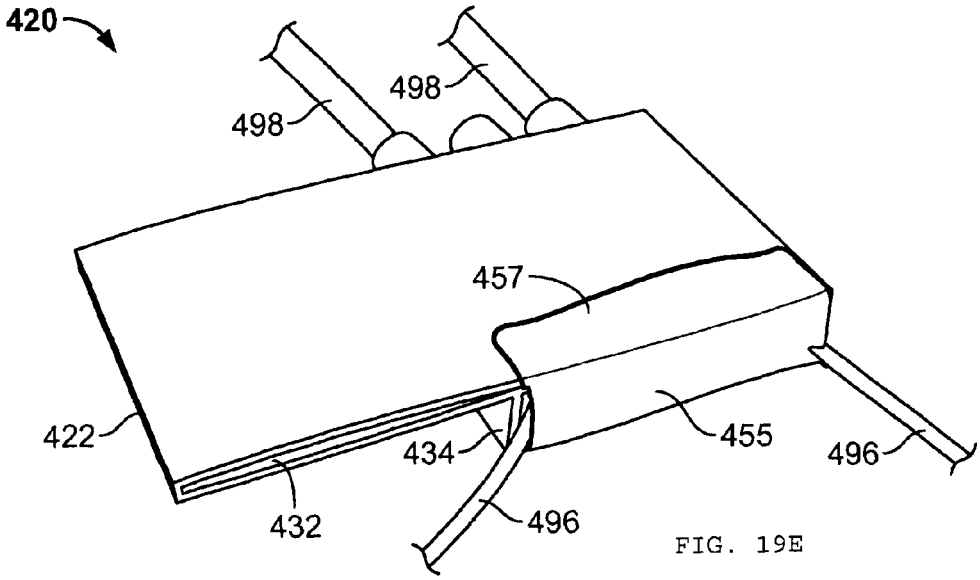
Figure 19F:
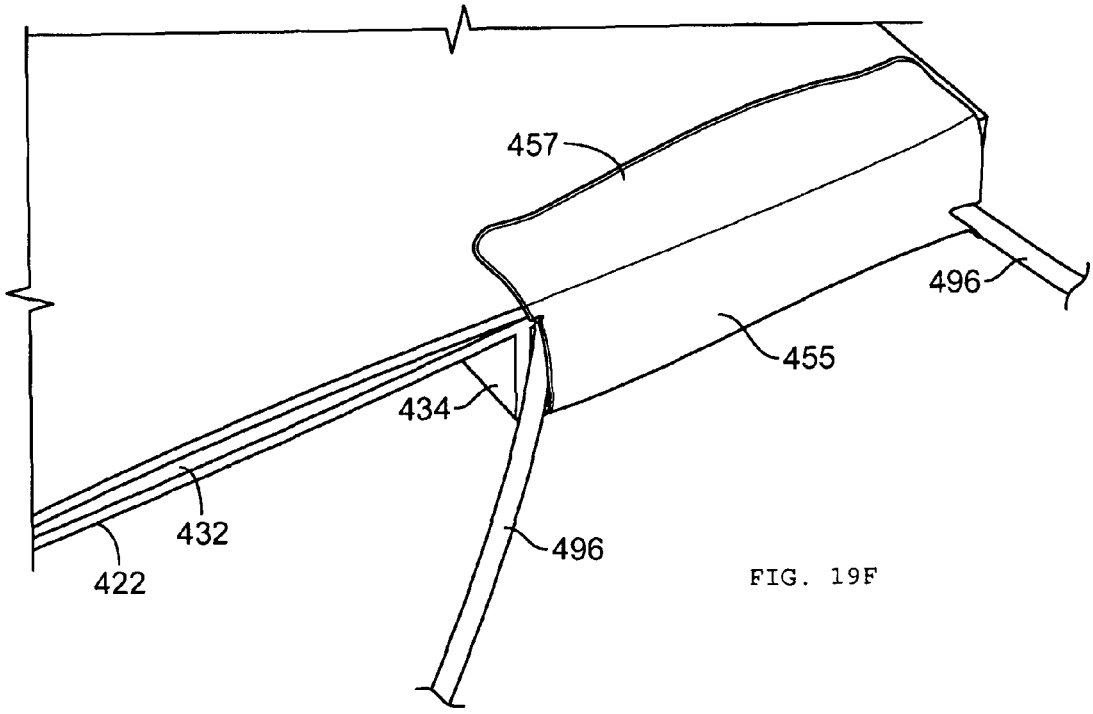

The adhesive label may be used for holding electrical wires in place prior to the wires being electrically interconnected with a light fixture. FIG. 19E shows an embodiment whereby electrical wires have been passed through flexible conduit 498 and the front opening of the storage compartment 434 for being pre-positioned to extend from the front of the mounting device 420. The adhesive label 455 preferably holds the electrical wires in place and seals the front of the storage compartment 434 to prevent construction debris from entering the storage compartment and at least a portion of the elongated slot 432 formed in the flat plate 422. Referring to FIG. 19F, when it is desired to secure a light fixture to the mounting device, the front flap 457 of the adhesive label 455 may be peeled away for exposing the front opening of the storage compartment 434 so that the electrical wires 496 may be electrically interconnected with a light fixture.

While the foregoing is directed to embodiments of the present invention, other and further embodiments of the invention may be devised without departing from the basic scope thereof, which is only limited by the scope of the claims that follow. For example, the present invention contemplates that any of the features shown in any of the embodiments described herein, or incorporated by reference herein, may be incorporated with any of the features shown in any of the other embodiments described herein, or incorporated by reference herein, and still fall within the scope of the present invention

What is claimed is:

1. A mounting system for securing a light fixture to a wall comprising:

a mounting device including a flat plate having a top planar surface and a bottom planar surface, an elongated slot extending between said top and bottom planar surfaces and along an edge of said flat plate, and a storage compartment defining an enclosed area underlying said bottom planar surface of said flat plate, wherein said bottom planar surface of said flat plate extends outside of said storage compartment, and wherein said top planar surface of said flat plate defines the upper-most surface of said mounting device;

said wall including a mortar layer having a top surface, wherein said mounting device is embedded in said mortar layer so that said top planar surface of said flat plate is coplanar with said top surface of said mortar layer and so that said storage compartment of said mounting device is below said top surface of said mortar layer.

2. The mounting system as claimed in claim 1, further comprising a light fixture having a securing flange projecting therefrom that is insertable into said elongated slot for securing said light fixture to said mounting device.

3. The mounting system as claimed in claim 2, wherein said light fixture comprises electrical wiring insertable into said enclosed area of said storage compartment.

4. The mounting system as claimed in claim 1, wherein said flat plate comprises a leading edge, a trailing edge, and said top and bottom planar surfaces extend between said leading and trailing edges, wherein said elongated slot extends along said leading edge of said flat plate, and wherein said storage compartment extends between said leading and trailing edges of said flat plate.

5. The mounting system as claimed in claim 4, wherein said flat plate has first and second lateral edges extending between said leading and trailing edges, said leading and trailing edges defining the width of said flat plate and said first and second lateral edges defining the length of said flat plate, wherein said bottom planar surface extends along the length of said flat plate to at least one of said first and second lateral edges of said flat plate, and wherein said storage compartment is located adjacent one of said first and second lateral edges of said flat plate.

6. The mounting system as claimed in claim 5, wherein said storage compartment has a front opening extending along said leading edge of said flat plate and a rear opening extending along said trailing edge of said flat plate, and wherein said system further comprises a peelable, adhesive label covering said front opening of said storage compartment and at least a portion of said elongated slot.

7. The mounting system as claimed in claim 6, wherein said storage compartment includes a bottom wall that opposes said bottom planar surface and a pair of opposing side walls that extend from said bottom wall to said bottom planar surface for defining said enclosed area of said storage compartment.

8. The mounting system as claimed in claim 7, wherein said bottom wall of said storage compartment is parallel with said top and bottom planar surfaces of said flat plate and said pair of opposing sidewalls of said storage compartment are perpendicular to said top and bottom planar surfaces of said flat plate.

9. The mounting system as claimed in claim 6, further comprising a conduit adapter coupled with said storage compartment, said conduit adapter having at least one opening aligned with said rear opening of said storage compartment.

10. The mounting system as claimed in claim 9, wherein said conduit adapter comprises:

a support plate having an inner face and an outer face;

a plug projecting from said inner face of said support plate, said plug having an outer perimeter that closely matches an inner perimeter of said rear opening of said storage compartment for forming a frictional engagement between said plug and said rear opening, wherein said at least one opening passes through said support plate and said plug.

11. The mounting system as claimed in claim 10, further comprising a conduit coupled with said at least one opening, wherein said conduit has a central opening adapted to receive electrical wiring connectable with said light fixture.

12. The mounting system as claimed in claim 11, wherein said at least one opening in said conduit adapter comprises two or more openings extending through said support plate and said plug, and wherein each of said conduit adapters has a conduit coupled therewith.

13. The mounting said as claimed in claim 2, wherein said elongated slot formed in said flat plate has a length of about 4-8 inches and a width of about 0.030-0.050 inches.

14. The mounting system as claimed in claim 13, wherein said securing flange projecting from said light fixture has a thickness that closely matches the width of said elongated slot for forming a friction fit when said securing flange is inserted into said elongated slot, and wherein said light fixture has a flat back side that closes said front opening of said storage compartment when said securing flange is fully inserted into said elongated slot of said mounting device.

15. A mounting system for securing a light fixture to a landscape wall comprising:

a mounting device comprising a flat plate having a leading edge a trailing edge, and top and bottom planar surfaces extending between said leading and trailing edges, an elongated slot formed in said flat plate, said elongated slot extending between said top and bottom planar surfaces and along said leading edge of said flat plate, a storage compartment underlying said flat plate, said storage compartment defining an enclosed area extending between said leading and trailing edges of said flat plate, wherein said storage compartment has a front opening extending along said leading edge of said flat plate and a rear opening extending along said trailing edge of said flat plate, wherein said bottom planar surface of said flat plate extends outside of said storage compartment, and wherein said top planar surface of said flat plate defines the upper-most surface of said mounting device;

a conduit adapter coupled with said storage compartment, said conduit adapter having at least one opening aligned with said rear opening of said storage compartment for providing access to said enclosed area of said storage compartment; and a conduit coupled with said at least one opening, wherein said conduit has a central opening adapted to receive electrical wiring;

said landscape wall including a mortar layer having a top surface, wherein said mounting device is embedded in said mortar layer so that said top planar surface of said flat plate is coplanar with said top surface of said mortar layer and so that said storage compartment of said mounting device is below said top surface of said mortar layer.

16. The mounting system as claimed in claim 15, wherein said storage compartment includes a bottom wall that opposes said bottom planar surface of said flat plate and a pair of opposing side walls that extend from said bottom wall to said bottom planar surface of said flat plate for defining said enclosed area of said storage compartment, and wherein said bottom wall of said storage compartment is bifurcated into a first part and a second part with an elongated gap extending between said first and second parts.

17. The mounting system as claimed in claim 15, wherein said landscape wall comprises a top row of blocks and said mounting device overlies said top row of blocks.

18. The mounting system as claimed in claim 17, wherein said mortar layer overlies said top row of blocks.

19. The mounting system as claimed in claim 18, further comprising a plurality of mounting devices embedded within said mortar layer and spaced from one another along a length of said landscape wall.

20. The mounting system as claimed in claim 19, further comprising light fixtures secured to each of said mounting devices, each said light fixture having a securing flange inserted into one of said elongated slots and electrical wiring packed into one of said enclosed areas, wherein each said light fixture has a flat back side that closes said front opening of said storage compartment when said securing flange is fully inserted into said elongated slot of said mounting device.

21. A mounting system for securing a light fixture to a wall comprising:

a mounting device including a flat plate having a top planar surface and a bottom planar surface, an elongated slot extending between said top and bottom planar surfaces and along an edge of said flat plate, and a storage compartment defining an enclosed area underlying said bottom planar surface of said flat plate, wherein said storage compartment includes a bottom wall that opposes said bottom planar surface and a pair of opposing side walls that extend from said bottom wall to said bottom planar surface for defining said enclosed area of said storage compartment, said bottom wall of said storage compartment being bifurcated into a first part and a second part with an elongated gap extending between said first and second parts, and wherein said bottom planar surface of said flat plate extends outside of said storage compartment.

22. The mounting system as claimed in claim 21, further comprising a mortar layer having a top surface overlying a row of blocks of said wall, wherein said mounting device is embedded in said mortar layer so that said top planar surface of said flat plate is coplanar with said top planar surface of said mortar layer and so that said storage compartment of said mounting device is below said top surface of said mortar layer.

* * * * *